US009580884B2

(12) United States Patent
Nakagaki et al.

(10) Patent No.: US 9,580,884 B2
(45) Date of Patent: Feb. 28, 2017

(54) INDUSTRIAL VEHICLE

(71) Applicant: YANMAR CO., LTD., Osaka-shi, Osaka (JP)

(72) Inventors: Mitsuhiro Nakagaki, Osaka (JP); Katsuya Miyazaki, Osaka (JP); Katashi Tanaka, Chikugo (JP); Mitsuhiro Takahashi, Chikugo (JP)

(73) Assignee: YANMAR CO., LTD. (JP)

( * ) Notice: Subject to any disclaimer, the term of this patent is extended or adjusted under 35 U.S.C. 154(b) by 0 days.

(21) Appl. No.: 14/911,584

(22) PCT Filed: May 26, 2014

(86) PCT No.: PCT/JP2014/063878
§ 371 (c)(1),
(2) Date: Feb. 11, 2016

(87) PCT Pub. No.: WO2015/025578
PCT Pub. Date: Feb. 26, 2015

(65) Prior Publication Data

US 2016/0186406 A1 Jun. 30, 2016

(30) Foreign Application Priority Data

Aug. 22, 2013 (JP) ..... 2013-172552
Aug. 22, 2013 (JP) ..... 2013-172553

(51) Int. Cl.
*G06F 7/70* (2006.01)
*E02F 3/43* (2006.01)
(Continued)

(52) U.S. Cl.
CPC ..... *E02F 3/435* (2013.01); *E02F 3/325* (2013.01); *E02F 3/425* (2013.01); *E02F 9/2033* (2013.01); *E02F 9/24* (2013.01)

(58) Field of Classification Search
None
See application file for complete search history.

(56) References Cited

U.S. PATENT DOCUMENTS 5,427,195 A * 6/1995 Paul ..... B60K 17/30 180/242
6,169,948 B1 1/2001 Fujishima et al.
(Continued)

FOREIGN PATENT DOCUMENTS

JP H0711673 A 1/1995
JP H108490 A 1/1998
(Continued)

OTHER PUBLICATIONS

International Search Report corresponding to Application No. PCT/JP2014/063878; Date of Mailing: Sep. 9, 2014, with English translation.

*Primary Examiner* — Adam Alharbi
(74) *Attorney, Agent, or Firm* — Cantor Colburn LLP

(57) ABSTRACT

The present invention addresses the problem of providing an industrial vehicle in which an industrial device can be reliably prevented from turning in a near direction beyond a restricted position. The solution is an industrial vehicle provided with an industrial device configured so as to be capable of turning about a joint in a near direction or an away direction, and a control device for restricting the turning of the industrial device so that the industrial device does not turn in the near direction beyond a restricted position, wherein the control device is configured such that an offset position is set in the away direction beyond the restricted position, and the control device initiates an action that stops the industrial device from turning in the near direction when the industrial device, which is turning in the near direction, has turned to the offset position.

6 Claims, 17 Drawing Sheets

(51) Int. Cl.

| | |
|---|---|
| ***E02F 9/24*** | (2006.01) |
| ***E02F 3/32*** | (2006.01) |
| ***E02F 3/42*** | (2006.01) |
| ***E02F 9/20*** | (2006.01) |

(56) References Cited

U.S. PATENT DOCUMENTS

| | | | | |
|---|---|---|---|---|
| 9,315,968 | B2 * | 4/2016 | Shang | E02F 9/2217 |
| 2014/0119868 | A1 * | 5/2014 | Wen | E02F 9/123<br>414/687 |

FOREIGN PATENT DOCUMENTS

| | | | |
|---|---|---|---|
| JP | 2000160604 | A | 6/2000 |
| JP | 2009228249 | A | 10/2009 |

* cited by examiner

INDUSTRIAL VEHICLE

This is the U.S. national stage of application No. PCT/JP2014/063878, filed on May 26, 2014. Priority under 35 U.S.C. §119(a) and 35 U.S.C. §365(b) is claimed from Japanese Application No. 2013-172552, filed Aug. 22, 2013, and from Japanese Application No. 2013-172553, filed Aug. 22, 2013, the disclosures of which are also incorporated herein by reference.

TECHNICAL FIELD

The present invention relates to an art of an industrial vehicle.

BACKGROUND ART

Conventionally, various arts concerning an industrial vehicle such as an agricultural vehicle, a construction vehicle, an industrial vehicle or the like are known.

There is the industrial vehicle having a working device and a control device such as a backhoe.

The working device of the industrial vehicle is equipped with an attachment such as a bucket, an oil pressure breaker, a fork or the like, and can rotate toward an approaching side or a separating side centering on a joint.

There is the industrial vehicle having a control device which restricts rotation of the working device toward the approaching side from a restriction position so as to prevent the attachment of the working device from contacting a vehicle body when the industrial vehicle is rotated toward the approaching side (see the Patent Literature 1).

PRIOR ART REFERENCE

Patent Literature

Patent Literature 1: the Japanese Patent Laid Open Gazette Hei. 10-8490

DISCLOSURE OF INVENTION

Problems to be Solved by the Invention

However, in the industrial vehicle, the state of rotation of the working device (for example, rotation speed of the working device) is not fixed always.

In the industrial vehicle, according to the state of rotation of the working device (for example, in the state in which the rotation speed of the working device is high), the working device may be rotated toward the approaching side from the restriction position.

The present invention is provided in consideration of the conditions as mentioned above, and the purpose of the invention is to provide an industrial vehicle which can prevent certainly rotation of a working device toward an approaching side from a restriction position.

Means for Solving the Problems

The problems to be solved by the present invention have been described above, and subsequently, the means of solving the problems will be described below.

According to the present invention, an industrial vehicle having a working device which is equipped with an attachment and can be rotated toward an approaching side and a separating side centering on a joint and a control device which restricts rotation of the working device toward the approaching side from a restriction position is characterized in that the control device is configured so that an offset position is set at the separating side from the restriction position, and when the working device rotating toward the approaching side reaches the offset position, an operation stopping the rotation of the working device toward the approaching side is started.

According to the present invention, an engine and a hydraulic circuit which has a hydraulic pump driven with the engine as a power source, rotates the working device by supplying pressure oil from the hydraulic pump to the working device, and stops the rotation of the working device by stopping the supply of the pressure oil from the hydraulic pump to the working device are provided, and the control device performs correction that the offset position is shifted to the approaching side or the separating side based on an angle speed at the time of rotation of the working device, a temperature of the pressure oil and/or a rotation speed of the engine.

According to the present invention, the control device is configured so that a restriction range is set at the separating side from the restriction position, and the rotation of the working device is restricted so as not to rotate the working device toward the approaching side when the rotation of the working device is stopped in the restriction range.

According to the present invention, the control device restricts the rotation of the working device so as not to rotate the working device toward the approaching side when the angle speed at the time of rotation of the working device is not more than a predetermined speed in the restriction range.

According to the present invention, the control device restricts the rotation of the working device so as not to rotate the working device toward the approaching side when a drop amount of rotation speed of the engine per unit time is not less than a predetermined amount in the restriction range.

According to the present invention, the control device performs correction of narrowing the restriction range to the approaching side or correction of expanding the restriction range to the separating side based on the rotation speed of the engine.

According to the present invention, in the state in which the rotation of the working device is restricted so as not to rotate the working device toward the approaching side, when an engine key switch is turned OFF while communication abnormality is detected, the control device releases the state of restricting the rotation of the working device toward the approaching side.

Effect of the Invention

The present invention brings the following effects.

According to the present invention, the rotation of the working device toward the approaching side from the restriction position can be prevented certainly.

DETAILED DESCRIPTION OF THE INVENTION

Next, a backhoe 1 which is an industrial vehicle according to an embodiment of the present invention is explained.

Though the backhoe 1 is the embodiment of the industrial vehicle in below explanation, the industrial vehicle is not limited thereto and may alternatively be another agricultural vehicle, construction vehicle, industrial vehicle or the like. For facilitating the explanation, a direction of an arrow F in a drawing is regarded as the front direction of the backhoe 1, and front, rear, left and right directions when riding on the backhoe 1 and turning to the front are regarded as the front, rear, left and right directions.

The backhoe 1 described in FIGS. 1 to 10 is explained.

Figure 1:
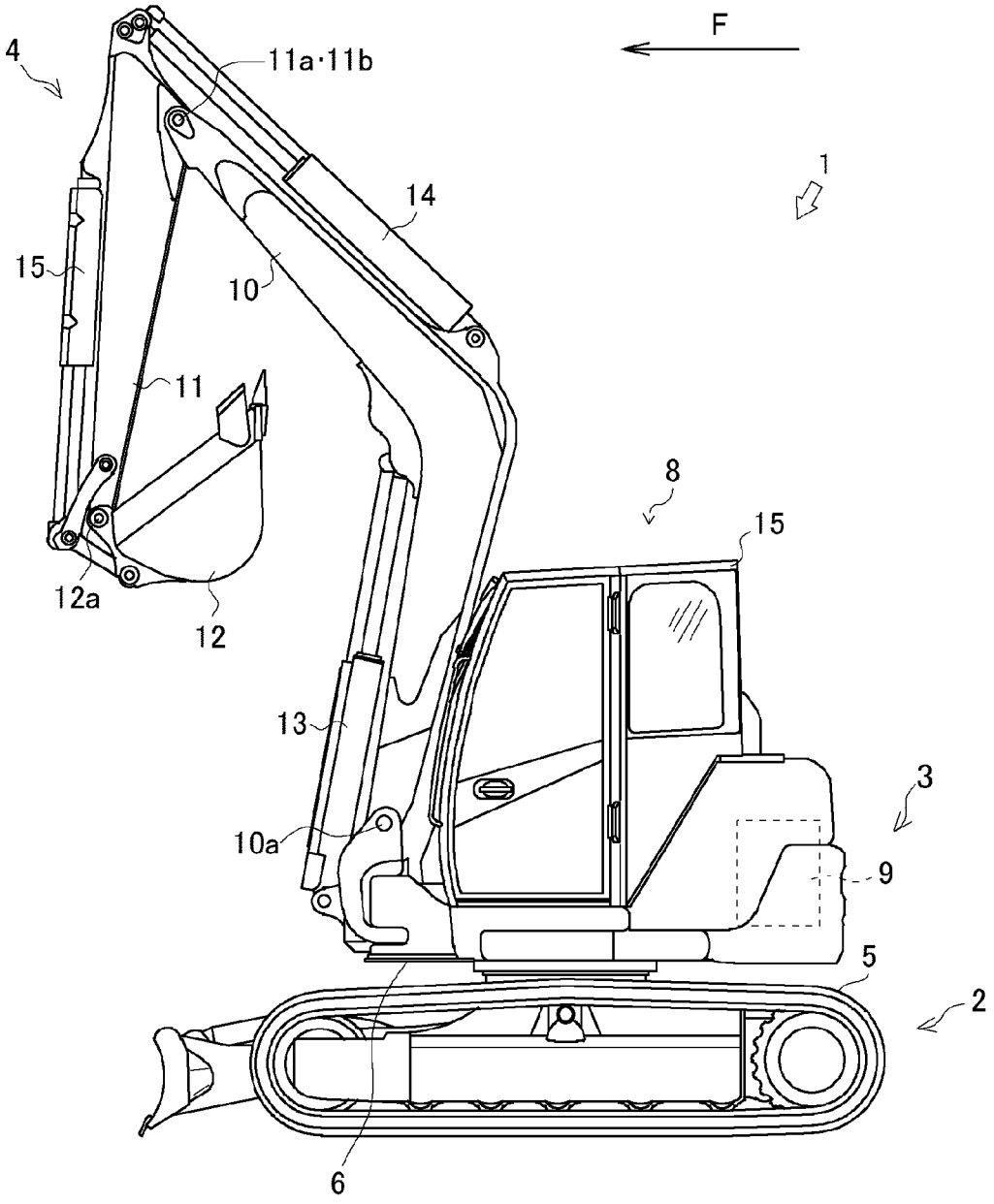
FIG. 1 is a side view of an entire configuration of an industrial vehicle according to an embodiment of the present invention.
Figure 2:
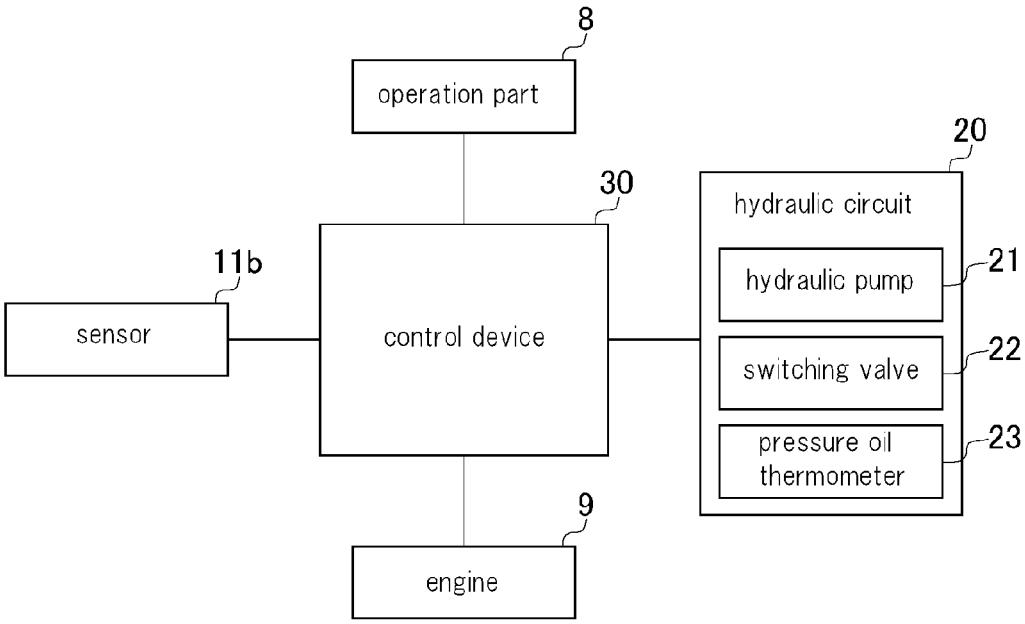
FIG. 2 is a block diagram of a configuration of members connected to a control device of the industrial vehicle.

As shown in FIG. 1 or 2, the backhoe 1 has a traveling device 2, a revolving device 3, a working device 4, a hydraulic circuit 20 and a control device 30.

The traveling device 2 of the backhoe 1 has a pair of left and right crawlers 5 and a traveling hydraulic motor (not shown).

The traveling device 2 is configured so as to make the backhoe 1 (vehicle body) travels forward and rearward and turn by driving the crawlers 5 respectively by the traveling hydraulic motor.

The revolving device 3 of the backhoe 1 has a revolving base 6, an operation part 8 and an engine 9. The revolving device 3 is configured by arranging the operation part 8 and the engine 9 on the revolving base 6.

The revolving base 6 is arranged above the traveling device 2 and supported rotatably by the traveling device 2. The revolving base 6 is configured so as to revolve with respect to the traveling device 2 by a revolving motor (not shown).

The operation part 8 has various operation instruments (a display device, an operation lever, an engine key switch directing start and stop of the engine 9, and the like).

The engine 9 is a power source of various devices of the backhoe 1.

The working device 4 of the backhoe 1 is equipped with an attachment and can rotate toward an approaching side and a separating side centering on a joint.

The working device 4 mainly has a boom 10, an arm 11, a bucket 12, a boom cylinder 13, an arm cylinder 14, and an attachment cylinder 15.

The boom 10 of the working device 4 of the backhoe 1 is configured so that one of ends of the boom 10 is rotatably supported by a boom fulcrum 10*a*, which is a joint, on a front part of the revolving base 6 of the revolving device 3.

The boom 10 is configured so as to be rotated centering on the boom fulcrum 10*a* by a boom cylinder 13 which is driven contractably. The boom 10 is configured so as to be rotated upward (a direction separating the other end of the boom 10 from the revolving base 6 of the revolving device 3) when the boom cylinder 13 is extended, and rotated downward (a direction making the other end of the boom 10 close to the revolving base 6 of the revolving device 3) when the boom cylinder 13 is contracted.

The arm 11 of the working device 4 of the backhoe 1 is configured so that one of ends of the arm 11 is rotatably supported by an arm fulcrum 11*a* on the other end of the boom 10.

The arm 11 is configured so as to be rotated centering on the arm fulcrum 11*a* by an arm cylinder 14 which is driven contractably. The arm 11 is configured so as to be rotated toward the approaching side (a direction approaching to the revolving device 3) when the arm cylinder 14 is extended, and rotated toward the separating side (a direction separating from the revolving device 3) when the arm cylinder 14 is contracted. The arm 11 is configured so as to be rotated downward (a direction making the other end of the arm 11 close to the boom 10) when the arm cylinder 14 is extended, and rotated upward (a direction separating the other end of the arm 11 from the boom 10) when the arm cylinder 14 is contracted.

The working device 4 of the backhoe 1 is configured so that a sensor 11*b*, which detects a rotation position of the arm 11 (swinging angle of the arm 11) and an angle speed at the time of rotation of the arm 11, is provided at the one of the ends of the arm 11. The sensor 11*b* is configured by a potentiometer.

The bucket 12 of the working device 4 of the backhoe 1 is a kind of the attachment.

The bucket 12 is rotatably supported by an attachment fulcrum 12*a*, which is a joint, on the other end of the arm 11.

The bucket 12 is configured so as to be rotated centering on the attachment fulcrum 12*a* by an attachment cylinder 15 which is driven contractably. The bucket 12 is configured so as to be rotated downward (a direction making the other end of the bucket 12 close to the arm 11) when the attachment cylinder 15 is extended, and rotated upward (a direction separating the other end of the bucket 12 from the arm 11) when the attachment cylinder 15 is contracted.

As the above, the working device 4 of the backhoe 1 is equipped with the bucket 12 which is the attachment and performs digging of earth and sand and the like with the bucket 12.

Other than the bucket 12, the attachment with which the working device 4 of the backhoe 1 is equipped includes an oil pressure breaker, a fork and the like for example.

The hydraulic circuit 20 of the backhoe 1 has a hydraulic pump 21, a switching valve (electromagnetic valve) 22, a pressure oil thermometer 23 and the like.

The hydraulic circuit 20 is configured so that pressure oil is supplied from the hydraulic pump 21 to the working device (the boom cylinder 13, the arm cylinder 14 or the attachment cylinder 15) so as to rotate the working device (the boom 10, the arm 11 or the bucket 12), and the supply of the pressure oil from the hydraulic pump 21 to the working device is stopped so as to stop the rotation of the working device.

The hydraulic circuit 20 performs the supply of the pressure oil from the hydraulic pump 21 to the working device or the stop of the supply of the pressure oil from the hydraulic pump 21 to the working device by the switching valve 22 (ON/OFF operation of the switching valve 22).

The hydraulic pump 21 of the hydraulic circuit 20 is configured so as to be driven with the engine 9 as the power source.

The pressure oil thermometer 23 of the hydraulic circuit 20 is configured so as to measure temperature of the pressure oil of the hydraulic circuit 20.

The control device 30 of the backhoe 1 has an ECU, a hydraulic circuit control unit (not shown) and the like, and is connected to the traveling device 2, the revolving device 3 (the revolving base 6, the operation part 8 and the engine 9 of the revolving device 3), the working device 4 (the sensor 11*b* of the working device 4), the hydraulic circuit 20 (the hydraulic pump 21, the switching valve 22 and the pressure oil thermometer 23 of the hydraulic circuit 20) and the like.

The control device 30 is configured so as to control the traveling device 2, the revolving device 3 (the revolving base 6, the operation part 8 and the engine 9 of the revolving device 3), the working device 4 (the sensor 11*b* of the working device 4), the hydraulic circuit 20 (the hydraulic pump 21, the switching valve 22 and the pressure oil thermometer 23 of the hydraulic circuit 20) and the like.

Various programs for controlling the traveling device 2, the revolving device 3 (the revolving base 6, the operation part 8 and the engine 9 of the revolving device 3), the working device 4 (the sensor 11*b* of the working device 4), the hydraulic circuit 20 (the hydraulic pump 21, the switching valve 22 and the pressure oil thermometer 23 of the hydraulic circuit 20) and the like are stored in the control device 30. The control device 30 can perform predetermined calculations according to these programs and can store results of the calculations and the like.

The control device 30 of the backhoe 1 is connected to the engine 9, the various operation instruments of the operation part 8, the hydraulic circuit 20 (the switching valve 22 and the pressure oil thermometer 23 of the hydraulic circuit 20) and the sensor 11*b* of the working device 4 (see FIG. 2).

The control device 30 is configured so as to transmit control signals to the engine 9, the various operation instruments of the operation part 8, the hydraulic circuit 20 (the switching valve 22 and the pressure oil thermometer 23 of the hydraulic circuit 20) and the sensor 11*b* of the working device 4, and obtain various kinds of information from the engine 9, the various operation instruments of the operation part 8, the hydraulic circuit 20 (the switching valve 22 and the pressure oil thermometer 23 of the hydraulic circuit 20) and the sensor 11*b* of the working device 4.

The control device 30 is configured so as to obtain information about the rotation speed of the engine 9 from the engine 9, information about the temperature of the pressure oil of the hydraulic circuit 20 from the pressure oil thermometer 23, information about the rotation position of the arm 11 from the sensor 11*b* of the working device 4, and information about the angle speed at the time of rotation of the arm 11 from the sensor 11*b* of the working device 4.

The control device 30 of the backhoe 1 stores restriction position information, offset position information and restriction releasing position information.

The restriction position information of the control device 30 of the backhoe 1 concerns to a restriction position A restricting rotation of the working device 4 (the arm 11 of the working device 4) toward the approaching side.

Figure 3:
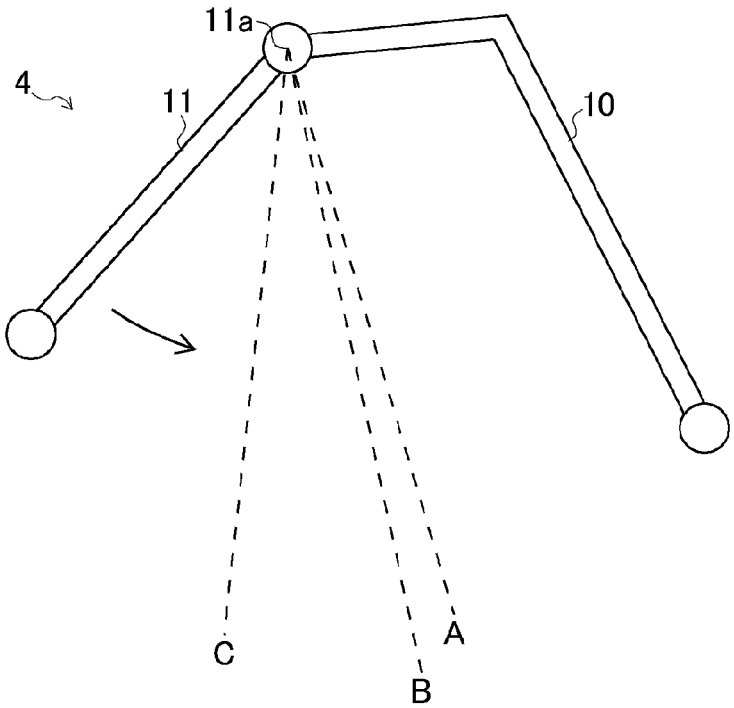
FIG. 3 is a schematic drawing of a rotation state of a working device of the industrial vehicle.

For preventing the working device 4 (the bucket 12 of the working device 4) from contacting the vehicle body (the boom 10 of the working device 4) when the working device 4 (the arm 11 of the working device 4) is rotated toward the approaching side, the control device 30 is configured so as to restrict the rotation of the working device 4 (the arm 11 of the working device 4) so that the working device 4 (the arm 11 of the working device 4) is not rotated toward the approaching side from the restriction position A (see FIG. 3).

The backhoe 1 is configured so that the working device 4 (the arm 11 of the working device 4) can be rotated toward the separating side even if the rotation of the working device 4 (the arm 11 of the working device 4) toward the approaching side is restricted.

The offset position information of the control device 30 of the backhoe 1 concerns to an offset position B at which an operation stopping the rotation of the working device 4 (the arm 11 of the working device 4) is started in the case in which the rotation of the working device 4 toward the approaching side is restricted.

The control device 30 is configured so that the offset position B is set closer to the separating side from the restriction position A.

Figure 4:
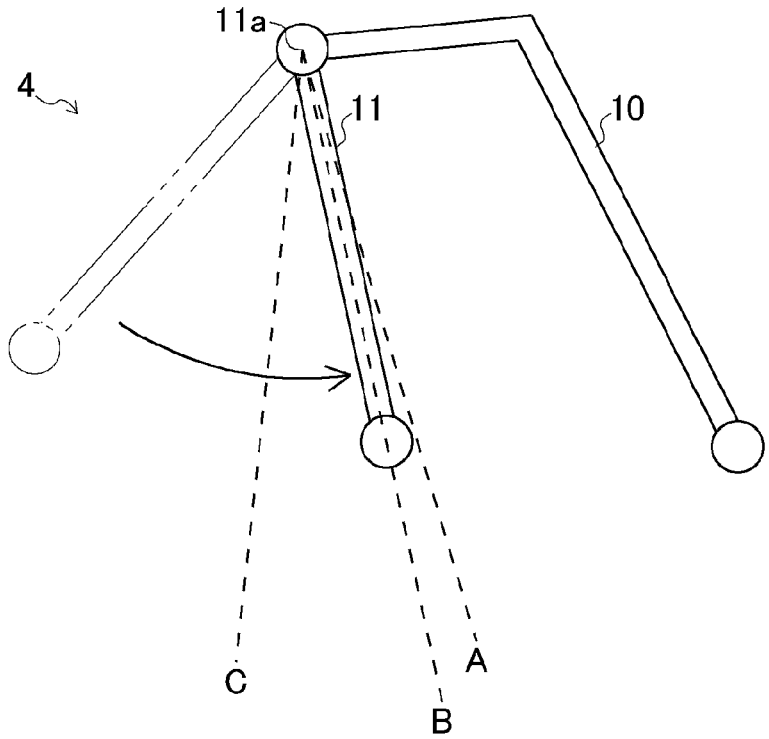
FIG. 4 is a schematic drawing of a rotation state of the working device of the industrial vehicle.

The control device 30 is configured so that the operation stopping the rotation of the working device 4 (the arm 11 of the working device 4) toward the approaching side is started when the working device 4 (the arm 11 of the working device 4) rotating toward the approaching side (see FIG. 4).

The control device 30 is configured so that when the working device 4 (the arm 11 of the working device 4) rotating toward the approaching side reaches the offset position, the switching valve 22 of the hydraulic circuit 20 is turned ON so as to stop the supply of the pressure oil from the hydraulic pump 21 to the working device 4 (the arm 11 of the working device 4), whereby the operation stopping the rotation of the working device 4 (the arm 11 of the working device 4) is started.

Figure 5:
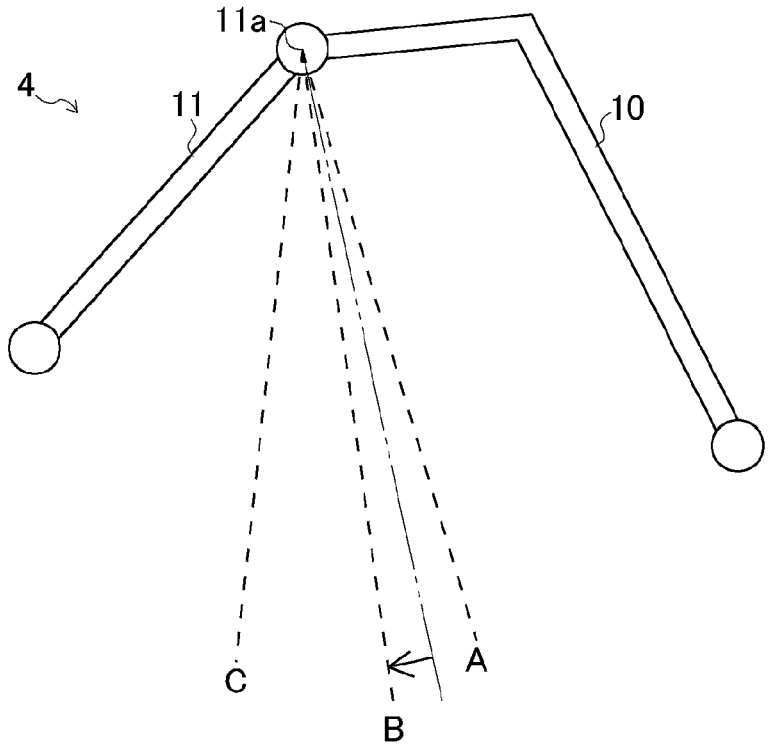
FIG. 5 is a schematic drawing of a rotation state of the working device of the industrial vehicle.
Figure 6:
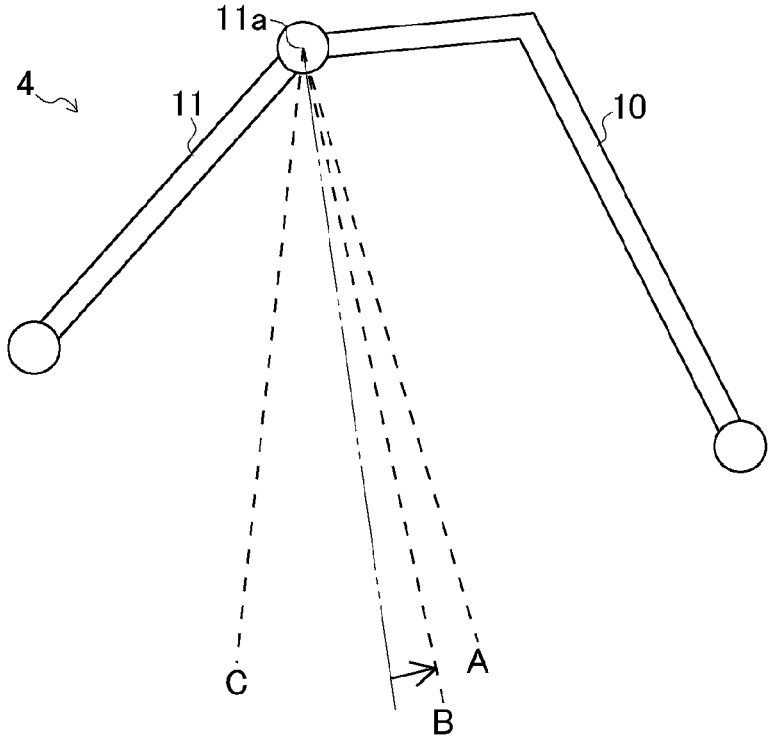
FIG. 6 is a schematic drawing of a rotation state of the working device of the industrial vehicle.

The control device 30 of the backhoe 1 is configured to perform correction that the offset position B set actually is shifted to the approaching side or the separating side based on various kinds of information obtained from the hydraulic circuit 20 (the switching valve 22 and the pressure oil thermometer 23 of the hydraulic circuit 20) and/or the sensor 11*b* of the working device 4 (see FIGS. 5 and 6).

The control device 30 of the backhoe 1 is configured to perform correction that the offset position B set actually is shifted to the approaching side or the separating side based on the angle speed at the time of rotation of the working device 4 (the arm 11 of the working device 4), the temperature of the pressure oil of the hydraulic circuit 20, and/or the rotation speed of the engine 9.

At this time, the control device 30 refers to the angle speed of the working device 4 (the arm 11 of the working device 4), the temperature of the pressure oil of the hydraulic circuit 20 and/or the rotation speed of the engine 9 and a map stored previously in the control device 30 so as to calculate a correction value for correcting the offset position B, and sets the new offset position B at the approaching side or the separating side from the offset position B set actually, thereby performing the correction that the offset position B set actually is shifted to the approaching side or the separating side.

The control device 30 is configured to perform correction that the offset position B set actually is shifted to the separating side when the working device 4 (the arm 11 of the working device 4) is relatively high, the temperature of the pressure oil of the hydraulic circuit 20 is relatively low, and/or the rotation speed of the engine 9 is relatively high. The control device 30 is configured to perform correction that the offset position B set actually is shifted to the approaching side when the working device 4 (the arm 11 of the working device 4) is relatively low, the temperature of the pressure oil of the hydraulic circuit 20 is relatively high, and/or the rotation speed of the engine 9 is relatively low.

The restriction releasing position information of the control device 30 of the backhoe 1 concerns to a restriction releasing position C at which restriction of rotation of the working device 4 (the arm 11 of the working device 4) toward the approaching side is released.

The control device 30 is configured so that the restriction releasing position C is set closer to the separating side from the offset position B.

Figure 7:
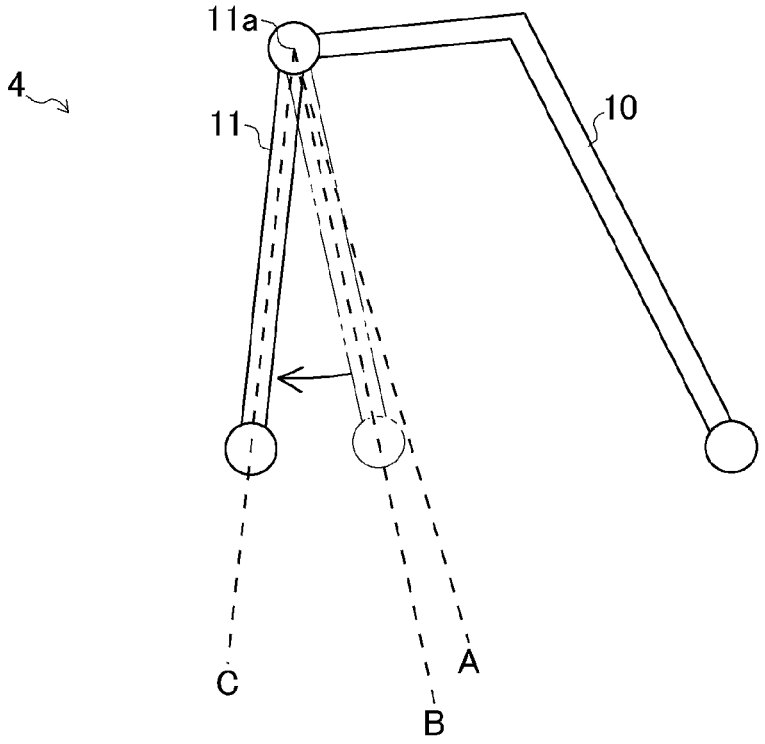
FIG. 7 is a schematic drawing of a rotation state of the working device of the industrial vehicle.

The control device 30 is configured so that in the state in which the rotation of the working device 4 (the arm 11 of the working device 4) toward the approaching side is restricted, when the working device 4 (the arm 11 of the working device 4) rotated toward the separating side reaches the restriction releasing position C, the restriction of rotation of the working device 4 (the arm 11 of the working device 4) toward the approaching side is released (see FIG. 7).

The control device 30 of the backhoe 1 is configured to detect communication abnormality between the control device 30 and the devices of the backhoe 1 connected to the control device 30 (the traveling device 2, the revolving device 3, the working device 4 and the hydraulic circuit 20) (CAN communication abnormality).

The control device 30 of the backhoe 1 is configured to detect turning OFF of the engine key switch of the operation part 8 when the engine key switch of the operation part 8 is turned OFF (operation of the engine 9 is stopped).

The control device 30 is configured so that in the state in which the rotation of the working device 4 (the arm 11 of the working device 4) toward the approaching side is restricted, when the engine key switch of the operation part 8 is turned OFF (the operation of the engine 9 is stopped) while the communication abnormality (CAN communication abnormality) is detected, the state in which rotation of the working device 4 (the arm 11 of the working device 4) is restricted so as not to rotate the working device 4 (the arm 11 of the working device 4) toward the approaching side is released.

Figure 8:
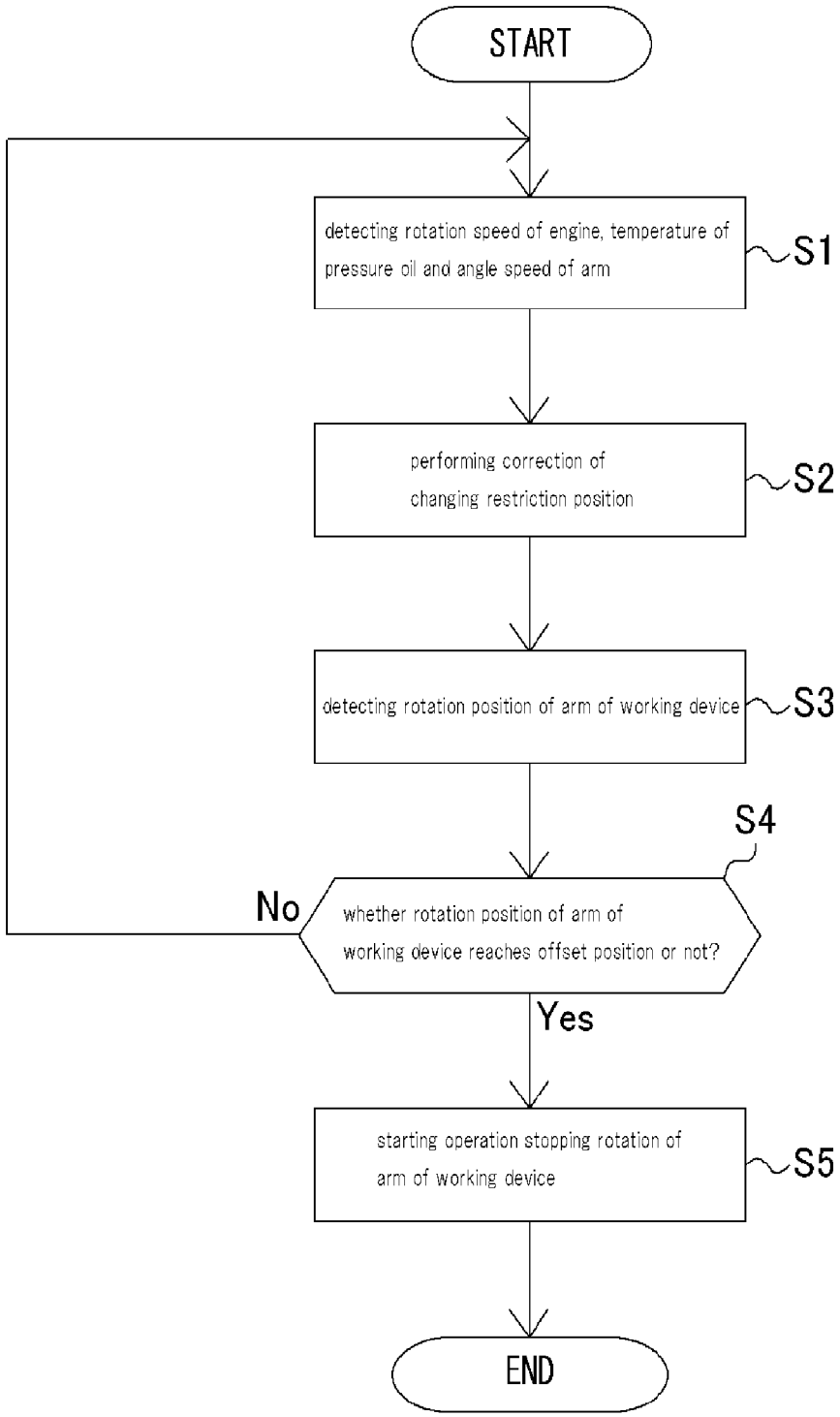
FIG. 8 is a flow chart of operation of the industrial vehicle.

Next, referring to FIG. 8, a series of operation in the backhoe 1 that the control device 30 stops the rotation of the working device 4 (the arm 11 of the working device 4) toward the approaching side when the working device 4 (the arm 11 of the working device 4) rotating toward the approaching side reaches the offset position B is explained.

As shown in FIG. 8, the control device 30 of the backhoe 1 detects the rotation speed of the engine 9, the temperature of the pressure oil of the hydraulic circuit 20 and the angle speed of the arm 11 of the working device 4 at the time of rotation (step S1).

At this time, the control device 30 obtains information about the rotation speed of the engine 9 from the engine 9, information about the temperature of the pressure oil of the hydraulic circuit 20 from the pressure oil thermometer 23 of the pressure oil of the hydraulic circuit 20, or information about the angle speed at the time of rotation of the arm 11 from the sensor 11*b* of the working device 4 so as to detect the rotation speed of the engine 9, the temperature of the pressure oil of the hydraulic circuit 20 and the angle speed of the arm 11 of the working device 4 at the time of rotation.

After detecting the rotation speed of the engine 9, the temperature of the pressure oil of the hydraulic circuit 20 and the angle speed of the arm 11 of the working device 4 at the time of rotation (step S1), the control device 30 shifts to a step S2.

Next, based on the angle speed of the working device 4 (the arm 11 of the working device 4), the temperature of the pressure oil of the hydraulic circuit 20 and/or the rotation speed of the engine 9, the control device 30 of the backhoe 1 performs the correction that the offset position B is shifted to the approaching side or the separating side from the offset position set actually (step S2).

At this time, the control device 30 refers to the angle speed of the working device 4 (the arm 11 of the working device 4) at the time of rotation, the temperature of the pressure oil of the hydraulic circuit 20 and/or the rotation speed of the engine 9 and the map stored previously in the control device 30 so as to calculate the correction value for correcting the offset position B.

Subsequently, the control device 30 sets the new offset position B at the approaching side or the separating side from the offset position B set actually based on the calculated correction value for correcting the offset position B.

As the above, based on the angle speed of the working device 4 (the arm 11 of the working device 4), the temperature of the pressure oil of the hydraulic circuit 20 and/or the rotation speed of the engine 9, the control device 30 performs the correction that the offset position is shifted to the approaching side or the separating side from the offset position B set actually (see FIG. 5 or 6).

After performing the correction that the offset position B set actually is shifted to the approaching side or the separating side from the offset position set actually based on the angle speed of the working device 4 (the arm 11 of the working device 4), the temperature of the pressure oil of the hydraulic circuit 20 and/or the rotation speed of the engine 9 (step S2), the control device 30 shifts to a step S3.

Next, the control device 30 of the backhoe 1 detects the rotation position of the working device 4 (the arm 11 of the working device 4) rotated toward the approaching side (step S3).

At this time, the control device 30 obtains information about the rotation position of the working device 4 (the arm 11 of the working device 4) rotated toward the approaching side from the sensor 11*b* of the working device 4 so as to detect the rotation position of the working device 4 (the arm 11 of the working device 4) rotated toward the approaching side.

After detecting the rotation position of the working device 4 (the arm 11 of the working device 4) rotated toward the approaching side (step S3), the control device 30 shifts to a step S4.

Next, based on the rotation position of the working device 4 (the arm 11 of the working device 4) rotated toward the approaching side detected in the step S3, the control device 30 of the backhoe 1 judges whether the rotation position of the working device 4 (the arm 11 of the working device 4) rotated toward the approaching side reaches the offset position B or not (step S4).

When is judged not to be the rotation position of the working device 4 (the arm 11 of the working device 4) rotated toward the approaching side is judged not to reach the offset position B, the control device 30 shifts to the step S1.

When the rotation position of the working device 4 (the arm 11 of the working device 4) rotated toward the approaching side is judged to reach the offset position B (see FIG. 4), the control device 30 shifts to a step S5.

Next, the control device 30 of the backhoe 1 starts the operation stopping the rotation of the working device 4 (the arm 11 of the working device 4) toward the approaching side (step S5).

At this time, when the working device 4 (the arm 11 of the working device 4) rotated toward the approaching side is rotated to the offset position (see FIG. 4), the control device 30 turns ON the switching valve 22 of the hydraulic circuit 20 is so as to stop the supply of the pressure oil from the hydraulic pump 21 to the working device 4 (the arm 11 of the working device 4), whereby the operation stopping the rotation of the working device 4 (the arm 11 of the working device 4) is started.

Accordingly, in the backhoe 1, when the working device 4 (the arm 11 of the working device 4) rotated toward the approaching side is rotated to the offset position, the control device 30 performs the series of operation including starting for stopping the rotation of the working device 4 (the arm 11 of the working device 4) toward the approaching side.

As the above, in the backhoe 1 in which the control device 30 starts the operation stopping the rotation of the working device 4 (the arm 11 of the working device 4) toward the approaching side when the offset position B is set closer to the separating side from the restriction position A and the working device 4 (the arm 11 of the working device 4) rotated toward the approaching side is rotated to the offset position, the operation stopping the rotation of the working device 4 (the arm 11 of the working device 4) toward the approaching side is started when the working device 4 (the arm 11 of the working device 4) rotated toward the approaching side is rotated to the offset position B which is set closer to the separating side from the restriction position A.

Then, according to the backhoe 1, the rotation of the working device 4 (the arm 11 of the working device 4) toward the approaching side from the restriction position A can be prevented certainly.

As the above, in the backhoe 1 in which the control device 30 performs the correction that the offset position B is shifted to the approaching side or the separating side based on the angle speed of the working device 4 (the arm 11 of the working device 4) at the time of the rotation, the temperature of the pressure oil of the hydraulic circuit 20 and/or the rotation speed of the engine 9, the correction that the offset position B is shifted to the approaching side or the separating side so as to stop the working device 4 (the arm 11 of the working device 4) at the restriction position A (near the restriction position A) can be performed corresponding to the angle speed of the working device 4 (the arm 11 of the working device 4) at the time of the rotation, the temperature of the pressure oil of the hydraulic circuit 20 and/or the rotation speed of the engine 9.

Then, according to the backhoe 1, accuracy of stopping the working device 4 (the arm 11 of the working device 4) at the restriction position A (near the restriction position A) can be improved.

At this time, for example, at the time of high idling of the engine 9, when the working device 4 (the arm 11 of the working device 4) is operated at low speed, the control device 30 of the backhoe 1 performs the correction that the offset position B is shifted to the approaching side from the actual offset position B while weaving the angle speed of the working device 4 (the arm 11 of the working device 4) at the time of the rotation into the rotation speed of the engine 9 so as to prevent the working device 4 (the arm 11 of the working device 4) from being stopped at a position far from the restriction position A.

Accordingly, in the backhoe 1, at the time of high idling of the engine 9, when the working device 4 (the arm 11 of the working device 4) is operated at low speed, the working device 4 (the arm 11 of the working device 4) can be prevented from being stopped at a position far from the restriction position A.

Figure 9:
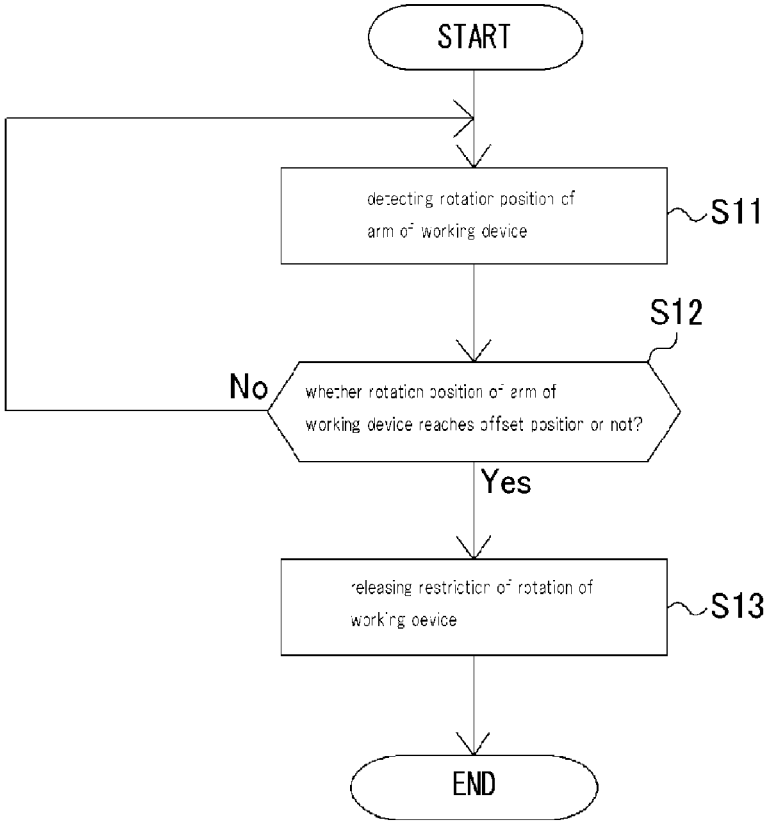
FIG. 9 is a flow chart of operation of the industrial vehicle.

Next, referring to FIG. 9, a series of operation in the backhoe 1 is explained that in the state in which the rotation of the working device 4 (the arm 11 of the working device 4) is restricted so as not to rotate the working device 4 (the arm 11 of the working device 4) toward the approaching side, when the working device 4 (the arm 11 of the working device 4) rotated toward the separating side reaches the restriction releasing position C, the control device 30 releases the restriction of rotation of the working device 4 (the arm 11 of the working device 4) toward the approaching side.

As shown in FIG. 9, in the state in which the rotation of the working device 4 (the arm 11 of the working device 4) is restricted so as not to rotate the working device 4 (the arm 11 of the working device 4) toward the approaching side, the control device 30 of the backhoe 1 detects the rotation position of the working device 4 (the arm 11 of the working device 4) rotated toward the separating side from the sensor 11*b* of the working device 4 (step S11).

At this time, the control device 30 obtains information about the rotation position of the working device 4 (the arm 11 of the working device 4) rotated toward the separating side from the sensor 11*b* of the working device 4 so as to detect the rotation position of the working device 4 (the arm 11 of the working device 4) rotated toward the separating side.

In the state in which the rotation of the working device 4 (the arm 11 of the working device 4) is restricted so as not to rotate the working device 4 (the arm 11 of the working device 4) toward the approaching side, after detecting the rotation position of the working device 4 (the arm 11 of the working device 4) rotated toward the separating side (step S11), the control device 30 shifts to a step S12.

Next, based on the rotation position of the working device 4 (the arm 11 of the working device 4) rotated toward the separating side detected in the step S11, the control device 30 of the backhoe 1 judges whether the rotation position of the working device 4 (the arm 11 of the working device 4) rotated toward the separating side reaches the restriction releasing position C or not (step S12).

When the rotation position of the working device 4 (the arm 11 of the working device 4) rotated toward the separating side is judged not to reach the restriction releasing position C, the control device 30 shifts to the step S11.

When the rotation position of the working device 4 (the arm 11 of the working device 4) rotated toward the separating side is judged to reach the restriction releasing position C (see FIG. 7), the control device 30 shifts to a step S13.

Next, the control device 30 of the backhoe 1 releases the state in which the rotation of the working device 4 (the arm 11 of the working device 4) is restricted so as not to rotate the working device 4 (the arm 11 of the working device 4) toward the approaching side (step S13).

Accordingly, in the state of the backhoe 1 in which the rotation of the working device 4 (the arm 11 of the working device 4) is restricted so as not to rotate the working device 4 (the arm 11 of the working device 4) toward the approaching side, when the working device 4 (the arm 11 of the working device 4) rotated toward the separating side reaches the restriction releasing position C, the control device 30 releases the restriction of rotation of the working device 4 (the arm 11 of the working device 4) toward the approaching side.

As the above, in the backhoe 1 configured so that the control device 30 releases the restriction of rotation of the working device 4 (the arm 11 of the working device 4) toward the approaching side when the working device 4 (the arm 11 of the working device 4) rotated toward the separating side reaches the restriction releasing position C in the state in which the restriction releasing position C is set closer to the separating side from the offset position B and the rotation of the working device 4 (the arm 11 of the working device 4) is restricted so as not to rotate the working device 4 (the arm 11 of the working device 4) toward the approaching side, by rotating the working device 4 (the arm 11 of the working device 4) toward the separating side to the restriction releasing position C in the state in which the rotation of the working device 4 (the arm 11 of the working device 4) is restricted so as not to rotate the working device 4 (the arm 11 of the working device 4) toward the approaching side, the restriction of rotation of the working device 4 (the arm 11 of the working device 4) toward the approaching side can be released.

Then, according to the backhoe 1, in the state in which the rotation of the working device 4 (the arm 11 of the working device 4) is restricted so as not to rotate the working device 4 (the arm 11 of the working device 4) toward the approaching side, the state in which the rotation of the working device 4 (the arm 11 of the working device 4) toward the approaching side is restricted can be released by easy operation of the working device 4.

Figure 10:
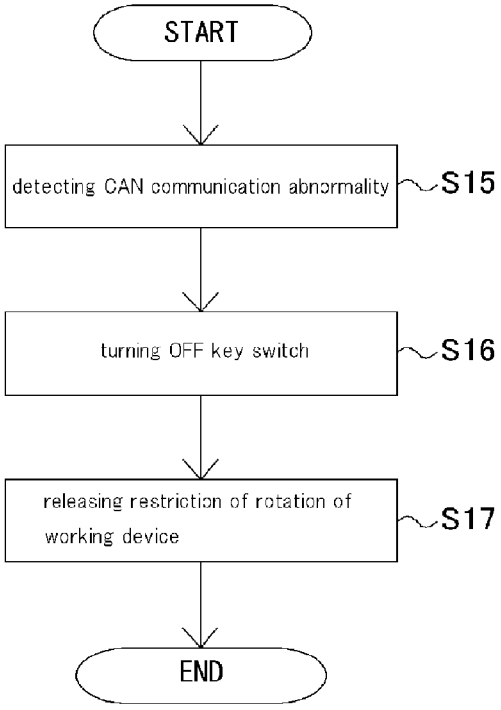
FIG. 10 is a flow chart of operation of the industrial vehicle.

Next, referring to FIG. 10, a series of operation in the backhoe 1 is explained that in the state in which the rotation of the working device 4 (the arm 11 of the working device 4) is restricted so as not to rotate the working device 4 (the arm 11 of the working device 4) toward the approaching side, when the engine key switch of the operation part 8 is turned OFF (the operation of the engine is stopped) while the communication abnormality (CAN communication abnormality) is detected, the control device 30 releases the state in which the rotation of the working device 4 (the arm 11 of the working device 4) is restricted so as not to rotate the working device 4 (the arm 11 of the working device 4) toward the approaching side.

As shown in FIG. 10, in the state in which the rotation of the working device 4 (the arm 11 of the working device 4) is restricted so as not to rotate the working device 4 (the arm 11 of the working device 4) toward the approaching side, the control device 30 of the backhoe 1 detects the communication abnormality (CAN communication abnormality) between the control device 30 and the devices of the backhoe 1 connected to the control device 30 (step S15).

After detecting the communication abnormality (CAN communication abnormality) in the state in which the rotation of the working device 4 (the arm 11 of the working device 4) is restricted so as not to rotate the working device 4 (the arm 11 of the working device 4) toward the approaching side (step S15), the control device 30 shifts to a step S16.

Next, the control device 30 of the backhoe 1 detects turning OFF of the engine key switch of the operation part 8 (stopping of the engine 9) (step S16).

After detecting the turning OFF of the engine key switch of the operation part 8 (step S16), the control device 30 shifts to a step S17.

Next, the control device 30 of the backhoe 1 releases the state in which the rotation of the working device 4 (the arm 11 of the working device 4) is restricted so as not to rotate the working device 4 (the arm 11 of the working device 4) toward the approaching side (step S17).

Accordingly, in the state of the backhoe 1 in which the rotation of the working device 4 (the arm 11 of the working device 4) is restricted so as not to rotate the working device 4 (the arm 11 of the working device 4) toward the approaching side, when the engine key switch of the operation part 8 is turned OFF (the operation of the engine 9 is stopped) while the communication abnormality (CAN communication abnormality) is detected, the control device 30 releases the state in which the rotation of the working device 4 (the arm 11 of the working device 4) is restricted so as not to rotate the working device 4 (the arm 11 of the working device 4) toward the approaching side.

As the above, in the backhoe 1 configured so that in the state in which the rotation of the working device 4 (the arm 11 of the working device 4) is restricted so as not to rotate the working device 4 (the arm 11 of the working device 4) toward the approaching side, when the engine key switch of the operation part 8 is turned OFF (the operation of the engine is stopped) while the communication abnormality (CAN communication abnormality) is detected, the control device 30 releases the state in which the rotation of the working device 4 (the arm 11 of the working device 4) is restricted so as not to rotate the working device 4 (the arm 11 of the working device 4) toward the approaching side, by turning OFF the engine key switch of the operation part 8 while the communication abnormality (CAN communication abnormality) is detected, the state in which the rotation of the working device 4 (the arm 11 of the working device 4) toward the approaching side is restricted can be released.

Then, according to the backhoe 1, the state that each part of the backhoe 1 cannot be operated at the time of the communication abnormality (CAN communication abnormality) and the state in which the rotation of the working device 4 (the arm 11 of the working device 4) toward the approaching side cannot be released can be prevented.

In the backhoe 1, the plurality of the restriction position information which are different from each other at the position restricting the rotation of the working device 4 (the arm 11 of the working device 4) toward the approaching side are stored in the control device 30, and the restriction position information can be selected from the plurality of the restriction position information by operating the operation instruments of the operation part 8 so as to set the restriction position A.

In the backhoe 1, the restriction position A can be set regardless of the rotation position of the working device 4 (the arm 11 of the working device 4) (even if the rotation position of the arm 11 of the working device 4 is closer to the offset position B).

Next, the backhoe 1 described in FIGS. 9 and 11 to 24 is explained.

In the explanation of the backhoe 1 described in FIGS. 9 and 11 to 24, parts of similar configuration to the backhoe 1 described in FIGS. 1 to 9 are omitted and parts different from the backhoe 1 described in FIGS. 1 to 9 are explained mainly.

The restriction position information, the restriction releasing position information and restriction range information are stored in the control device 30 of the backhoe 1.

The restriction range information of the control device 30 of the backhoe 1 concerns to a restriction range D.

Figure 11:
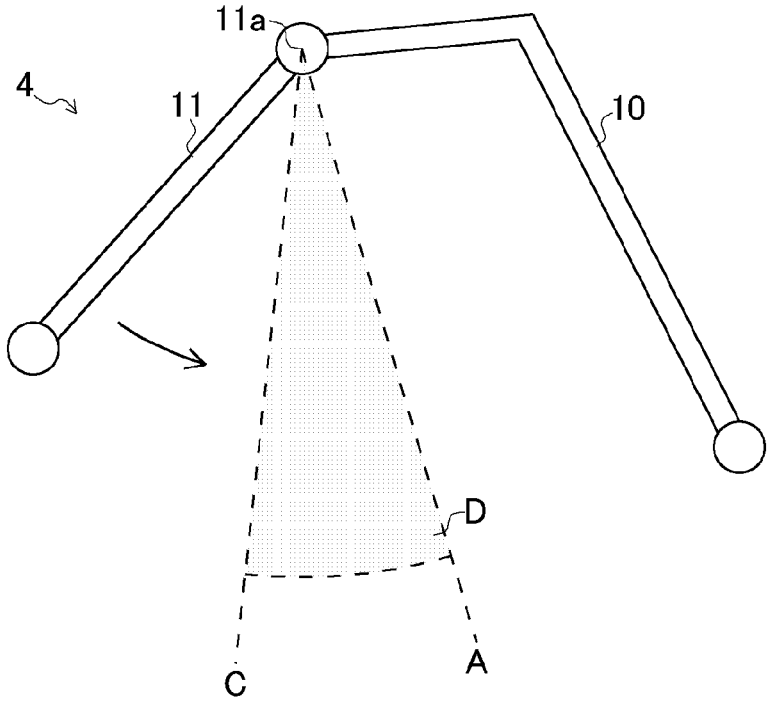
FIG. 11 is a schematic drawing of a rotation state of the working device of the industrial vehicle.

The control device 30 is configured so that the restriction range D is set at the separating side from the restriction position A (see FIG. 11).

The control device 30 is configured so that the rotation of the working device 4 (the arm 11 of the working device 4) is restricted so as not to rotate the working device 4 (the arm 11 of the working device 4) toward the approaching side when the rotation of the working device 4 (the arm 11 of the working device 4) is stopped in the restriction range D.

Figure 12:
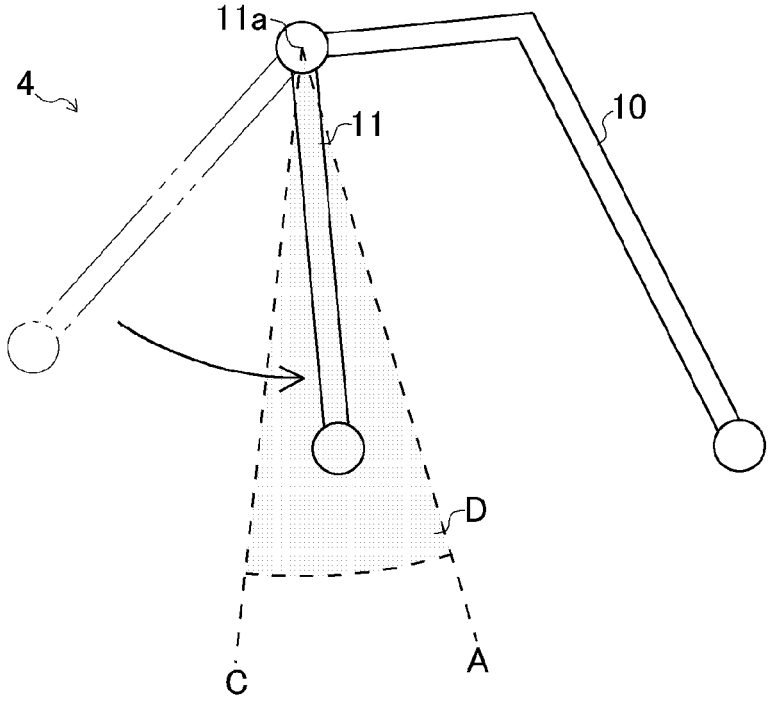
FIG. 12 is a schematic drawing of a rotation state of the working device of the industrial vehicle.

The control device 30 is configured so that the rotation of the working device 4 (the arm 11 of the working device 4) is restricted so as not to rotate the working device 4 (the arm 11 of the working device 4) toward the approaching side when the angle speed at the time of rotation of the working device 4 (the arm 11 of the working device 4) is not more than a predetermined speed in the restriction range D (see FIG. 12).

The control device 30 is configured so that the rotation of the working device 4 (the arm 11 of the working device 4) is restricted so as not to rotate the working device 4 (the arm 11 of the working device 4) toward the approaching side when drop amount of rotation speed of the engine 9 per unit time is not less than a predetermined amount in the restriction range D.

The predetermined speed of the angle speed at the time of rotation of the working device 4 (the arm 11 of the working device 4) is the rotation speed of the working device 4 (the arm 11 of the working device 4) in the state before increasing the speed suddenly and rotating the working device 4 (the arm 11 of the working device 4) in which the working device 4 (the arm 11 of the working device 4) may be rotated toward the approaching side from the restriction position A by increasing the speed suddenly and rotating the working device 4 (the arm 11 of the working device 4) toward the approaching side (for example, the speed at which the arm 11 of the working device 4 is substantially stopped).

Figure 13:
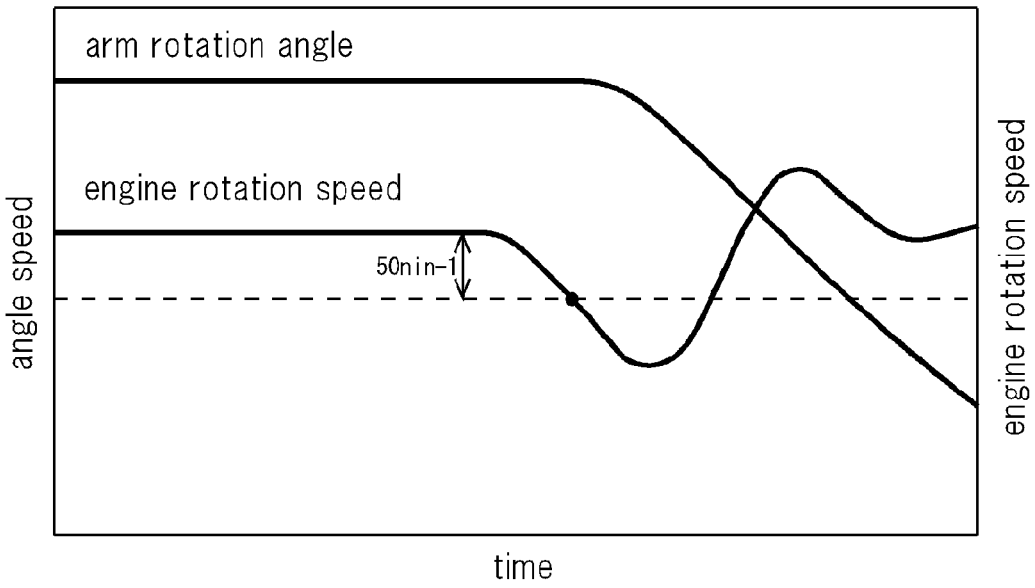
FIG. 13 is a diagram of relation between rotation speed of an engine and angle speed of an arm.

The predetermined amount of the drop amount of rotation speed of the engine 9 per unit time is the drop amount of rotation speed of the engine 9 at the moment of starting the rotation (just after starting the rotation) in the state in which the working device 4 (the arm 11 of the working device 4) may be rotated toward the approaching side from the restriction position A by increasing the speed suddenly and rotating the working device 4 (the arm 11 of the working device 4) toward the approaching side (for example, the drop amount of rotation speed of the engine 9 is 50 min-1) (see FIG. 13). In the backhoe 1, when the switching valve 22 is switched by operating the operation instruments of the operation part 8, hydraulic load of the pressure oil of the hydraulic circuit 20 is increased. As a result, in the backhoe 1, load of the engine 9 driving the hydraulic pump 21 is increased and the rotation speed of the engine 9 is dropped suddenly. Just after it, in the backhoe 1, pressure of the pressure oil of the hydraulic circuit 20 is increased and the rotation of the working device 4 is started.

Figure 14:
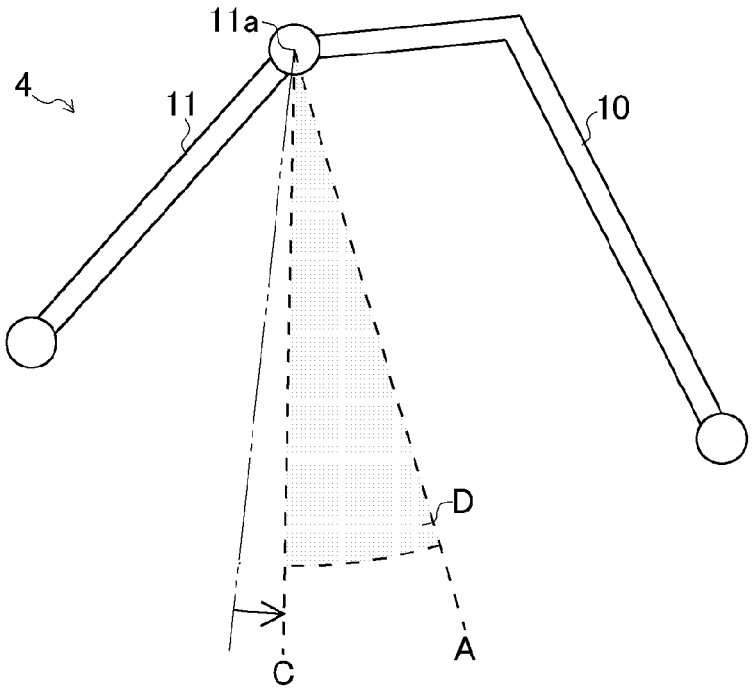
FIG. 14 is a schematic drawing of a rotation state of the working device of the industrial vehicle.
Figure 15:
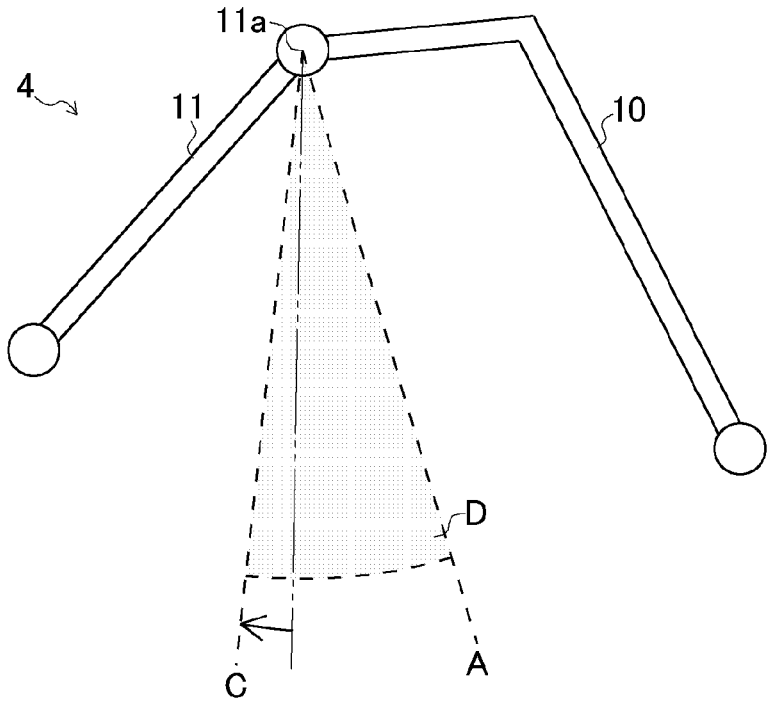
FIG. 15 is a schematic drawing of a rotation state of the working device of the industrial vehicle.

The control device 30 of the backhoe 1 is configured to perform correction of narrowing the restriction range D set actually to the approaching side or correction of expanding the restriction range D to the separating side based on the rotation speed of the engine 9 (see FIG. 14 or 15).

The control device 30 of the backhoe 1 is configured by setting the restriction releasing position C at a boundary part between the restriction range D and the outside of the restriction range D at the separating side.

Figure 16:
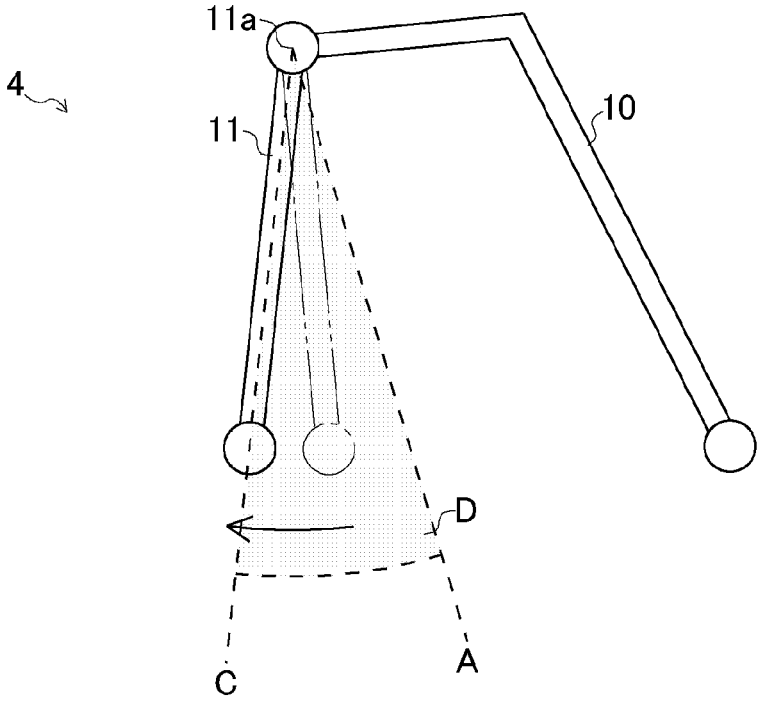
FIG. 16 is a schematic drawing of a rotation state of the working device of the industrial vehicle.

The control device 30 of the backhoe 1 is configured so that in the state in which the rotation of the working device 4 (the arm 11 of the working device 4) is restricted so as not to rotate the working device 4 (the arm 11 of the working device 4) toward the approaching side, when the working device 4 (the arm 11 of the working device 4) rotating toward the separating side reaches the restriction releasing position C, state in which the rotation of the working device 4 (the arm 11 of the working device 4) toward the approaching side is restricted is released (see FIG. 16).

Figure 17:
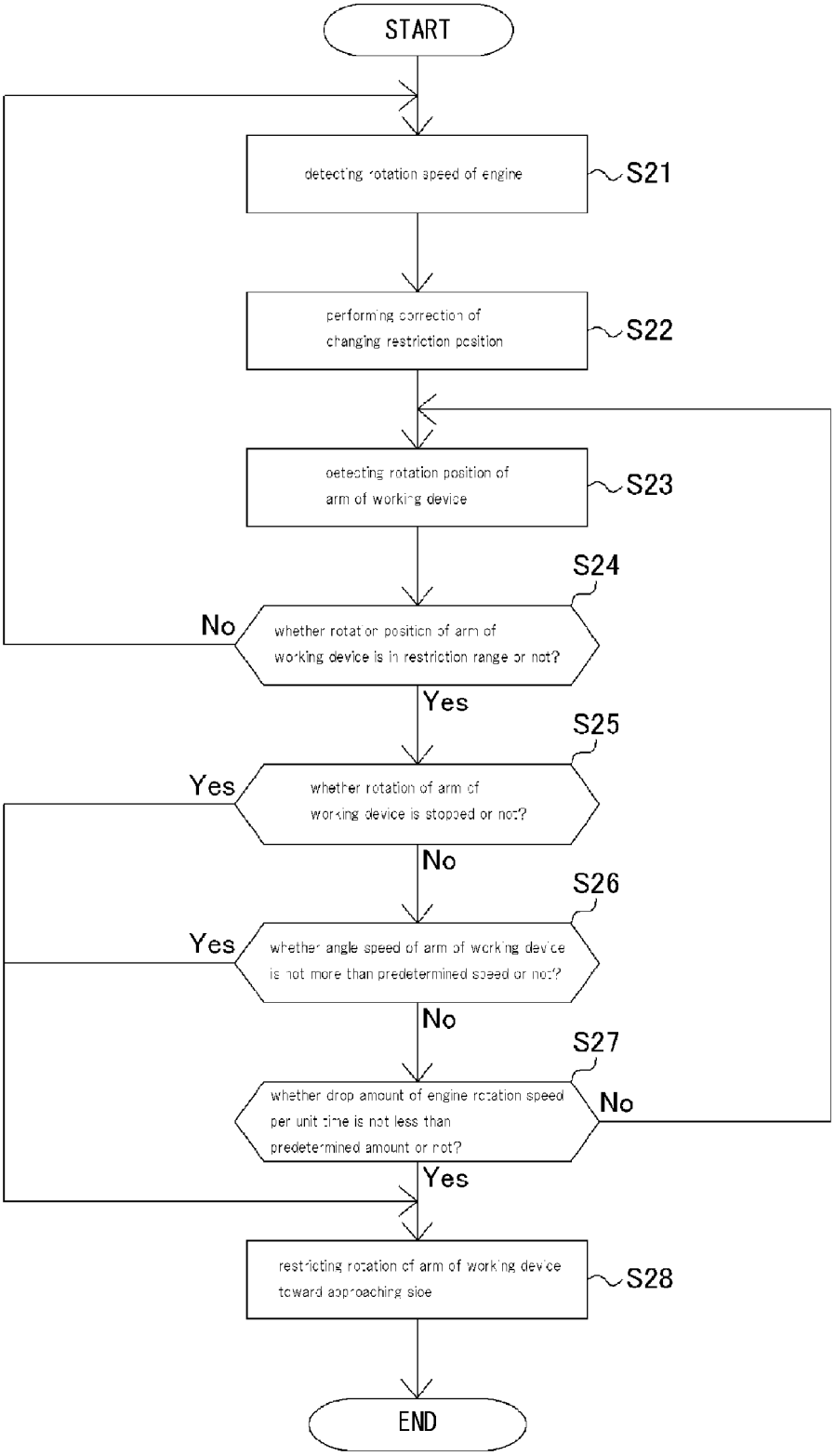
FIG. 17 is a flow chart of operation of the industrial vehicle.

Next, referring to FIG. 17, a series of operation in the backhoe 1 is explained that the rotation of the working device 4 (the arm 11 of the working device 4) is restricted so as not to rotate the working device 4 (the arm 11 of the working device 4) toward the approaching side in the restriction range D.

As shown in FIG. 17, the control device 30 of the backhoe 1 detects the rotation speed of the engine 9 (step S21).

At this time, the control device 30 obtains information about the rotation speed of the engine 9 from the engine 9 so as to detect the rotation speed of the engine 9.

After detecting the rotation speed of the engine 9 (step S21), the control device 30 shifts to a step S22.

Next, the control device 30 of the backhoe 1 performs the correction of narrowing the restriction range D set actually to the approaching side or the correction of expanding the restriction range D to the separating side based on the rotation speed of the engine 9 (step S22).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S22), the control device 30 shifts to a step S23.

Next, the control device 30 of the backhoe 1 detects the rotation position of the working device 4 (the arm 11 of the working device 4) (step S23).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S23), the control device 30 shifts to a step S24.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S23 (step S24).

When the rotation position of the working device 4 (the arm 11 of the working device 4) is judged not to be in the restriction range D, the control device 30 shifts to the step S21.

When the rotation position of the working device 4 (the arm 11 of the working device 4) is judged to be in the restriction range D (see FIG. 16), the control device 30 shifts to a step S25.

Next, the control device 30 of the backhoe 1 judges whether the rotation of the working device 4 (the arm 11 of the working device 4) is stopped in the restriction range D or not (step S25).

At this time, the control device 30 obtains information about the angle speed at the time of rotation of the arm 11 from the sensor 11*b* of the working device 4 so as to detect the angle speed at the time of rotation of the arm 11 of the working device 4.

Then, the control device 30 judges whether the rotation of the working device 4 (the arm 11 of the working device 4) is stopped in the restriction range D or not based on the detected angle speed at the time of rotation of the arm 11 of the working device 4.

When the rotation of the working device 4 (the arm 11 of the working device 4) is judged not to be stopped in the restriction range D, the control device 30 shifts to a step S26.

When the rotation of the working device 4 (the arm 11 of the working device 4) is judged to be stopped in the restriction range D (see FIG. 12), the control device 30 shifts to a step S28.

Next, the control device 30 of the backhoe 1 judges whether the angle speed at the time of rotation of the working device 4 (the arm 11 of the working device 4) is not more than the predetermined speed in the restriction range D or not (step S26).

At this time, the control device 30 judges whether the angle speed at the time of rotation of the working device 4 (the arm 11 of the working device 4) is not more than the predetermined speed in the restriction range D or not based on the angle speed at the time of rotation of the arm 11 of the working device 4 detected in the step S25.

When the angle speed at the time of rotation of the working device 4 (the arm 11 of the working device 4) is judged to be more than the predetermined speed in the restriction range D, the control device 30 shifts to a step S27.

When the angle speed at the time of rotation of the working device 4 (the arm 11 of the working device 4) is judged not to be more than the predetermined speed in the restriction range D, the control device 30 shifts to the step S28.

Next, the control device 30 of the backhoe 1 judges whether the drop amount of rotation speed of the engine 9 per unit time is not less than the predetermined amount in the restriction range D or not (step S27).

At this time, the control device 30 obtains information about the rotation speed of the engine 9 from the engine 9 so as to detect the rotation speed of the engine 9.

Then, the control device 30 judges whether the drop amount of rotation speed of the engine 9 per unit time is not less than the predetermined amount in the restriction range D or not based on the detected rotation speed of the engine 9 (see FIG. 13).

When the drop amount of rotation speed of the engine 9 per unit time is judged to be less than the predetermined amount in the restriction range D, the control device 30 shifts to the step S23.

When the drop amount of rotation speed of the engine 9 per unit time is judged not to be less than the predetermined amount in the restriction range D, the control device 30 shifts to the step S28.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S28).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

As the above, in the backhoe 1 in which the control device 30 is configured so that the restriction range D is set at the separating side from the restriction position A and the rotation of the working device 4 (the arm 11 of the working device 4) is restricted so as not to rotate the working device 4 (the arm 11 of the working device 4) toward the approaching side in the restriction range D when the rotation of the working device 4 (the arm 11 of the working device 4) is stopped, the rotation of the working device 4 (the arm 11 of the working device 4) is restricted so as not to rotate the working device 4 (the arm 11 of the working device 4) toward the approaching side in the state in which the rotation of the working device 4 (the arm 11 of the working device 4) is stopped in the restriction range D.

Then, according to the backhoe 1, in the state in which the rotation of the working device 4 (the arm 11 of the working device 4) at the separating side from the restriction position A (near the separating side from the restriction position A), when the working device 4 (the arm 11 of the working device 4) is rotated suddenly toward the approaching side, the working device 4 (the arm 11 of the working device 4) can be prevented from being rotated toward the approaching side from the restriction position A.

As the above, in the backhoe 1 in which the control device 30 is configured so that the rotation of the working device 4 (the arm 11 of the working device 4) is restricted so as not to rotate the working device 4 (the arm 11 of the working device 4) toward the approaching side when the angle speed at the time of rotation of the working device 4 (the arm 11 of the working device 4) is not more than the predetermined speed in the restriction range D, the rotation of the working device 4 (the arm 11 of the working device 4) is restricted so as not to rotate the working device 4 (the arm 11 of the working device 4) toward the approaching side in the state in which the angle speed at the time of rotation of the working device 4 (the arm 11 of the working device 4) is not more than the predetermined speed in the restriction range D.

Then, according to the backhoe 1, in the state in which the angle speed at the time of rotation of the working device 4 (the arm 11 of the working device 4) is not more than the predetermined speed, when the working device 4 (the arm 11 of the working device 4) is rotated suddenly toward the approaching side while increasing the speed, the working device 4 (the arm 11 of the working device 4) can be prevented from being rotated toward the approaching side from the restriction position A.

As the above, in the backhoe 1 in which the control device 30 is configured so that the rotation of the working device 4 (the arm 11 of the working device 4) is restricted so as not to rotate the working device 4 (the arm 11 of the working device 4) toward the approaching side when the drop amount of rotation speed of the engine 9 per unit time is not less than the predetermined amount in the restriction range D, the rotation of the working device 4 (the arm 11 of the working device 4) is restricted so as not to rotate the working device 4 (the arm 11 of the working device 4) toward the approaching side when the drop amount of rotation speed of the engine 9 per unit time is not less than the predetermined amount in the restriction range D.

As the above, in the backhoe 1, the timing of restricting the rotation of the working device 4 (the arm 11 of the working device 4) so as not to rotate the working device 4 (the arm 11 of the working device 4) toward the approaching side is judged from the drop amount of rotation speed of the engine 9 caused by increase of the hydraulic load. Accordingly, in comparison with the configuration of performing the judgement from the angle speed at the time of rotation of the working device 4 (the arm 11 of the working device 4), the judgement of restricting the rotation of the working device 4 (the arm 11 of the working device 4) so as not to rotate the working device 4 (the arm 11 of the working device 4) toward the approaching side can be performed more quickly.

Then, according to the backhoe 1, in comparison with the configuration of performing the judgement the timing of restricting the rotation of the working device 4 (the arm 11 of the working device 4) from the angle speed at the time of rotation of the working device 4 (the arm 11 of the working device 4), when the working device 4 (the arm 11 of the working device 4) is rotated suddenly toward the approaching side while increasing the speed, the working device 4 (the arm 11 of the working device 4) can be prevented more certainly from being rotated toward the approaching side from the restriction position A.

As the above, in the backhoe 1 in which the control device 30 is configured so as to performs the correction of narrowing the restriction range D set actually to the approaching side or the correction of expanding the restriction range D to the separating side based on the rotation speed of the engine 9, the correction of narrowing the restriction range D set actually to the approaching side or the correction of expanding the restriction range D to the separating side can be performed corresponding to the rotation speed of the engine 9 so as to stop the working device 4 (the arm 11 of the working device 4) at the restriction position A (near the restriction position A).

Then, according to the backhoe 1, accuracy of stopping the working device 4 (the arm 11 of the working device 4) at the restriction position A (near the restriction position A) can be improved.

Next, referring to FIG. 9, a series of operation in the backhoe 1 is explained that in the state in which the rotation of the working device 4 (the arm 11 of the working device 4) is restricted so as not to rotate the working device 4 (the arm 11 of the working device 4) toward the approaching side, when the working device 4 (the arm 11 of the working device 4) is rotated to the restriction releasing position C, the control device 30 releases the restriction of the rotation of the working device 4 (the arm 11 of the working device 4) toward the approaching side.

As shown in FIG. 9, in the state in which the rotation of the working device 4 (the arm 11 of the working device 4) is restricted so as not to rotate the working device 4 (the arm 11 of the working device 4) toward the approaching side, the control device 30 of the backhoe 1 detects the rotation position of the working device 4 (the arm 11 of the working device 4) rotated toward the separating side from the sensor 11*b* of the working device 4 (step S11).

After detecting the rotation position of the working device 4 (the arm 11 of the working device 4) rotated toward the separating side from the sensor 11*b* of the working device 4 in the state in which the rotation of the working device 4 (the arm 11 of the working device 4) is restricted so as not to rotate the working device 4 (the arm 11 of the working device 4) toward the approaching side (step S11), the control device 30 shifts to the step S12.

Next, based on the rotation position of the working device 4 (the arm 11 of the working device 4) rotated toward the separating side detected in the step S11, the control device 30 of the backhoe 1 judges whether the rotation position of the working device 4 (the arm 11 of the working device 4) rotated toward the separating side reaches the restriction releasing position C or not (step S12).

When the rotation position of the working device 4 (the arm 11 of the working device 4) rotated toward the separating side is judged not to reach the restriction releasing position C, the control device 30 shifts to the step S11.

When the rotation position of the working device 4 (the arm 11 of the working device 4) rotated toward the separating side is judged to reach the restriction releasing position C (see FIG. 16), the control device 30 shifts to the step S13.

Next, the control device 30 of the backhoe 1 releases the state in which the rotation of the working device 4 (the arm 11 of the working device 4) is restricted so as not to rotate the working device 4 (the arm 11 of the working device 4) toward the approaching side (step S13).

Accordingly, in the state of the backhoe 1 in which the rotation of the working device 4 (the arm 11 of the working device 4) is restricted so as not to rotate the working device 4 (the arm 11 of the working device 4) toward the approaching side, when the working device 4 (the arm 11 of the working device 4) rotated toward the separating side reaches the restriction releasing position C, the control device 30 releases the restriction of rotation of the working device 4 (the arm 11 of the working device 4) toward the approaching side.

As the above, in the backhoe 1 in which the control device 30 is configured so that the restriction range D is set at the separating side from the restriction position A, and in the state in which the rotation of the working device 4 (the arm 11 of the working device 4) is restricted so as not to rotate the working device 4 (the arm 11 of the working device 4) toward the approaching side, when the working device 4 (the arm 11 of the working device 4) rotated toward the separating side reaches the restriction releasing position C, the restriction of the rotation of the working device 4 (the arm 11 of the working device 4) toward the approaching side is released, by rotating the working device 4 (the arm 11 of the working device 4) toward the separating side reaches the restriction releasing position C in the state in which the rotation of the working device 4 (the arm 11 of the working device 4) is restricted so as not to rotate the working device 4 (the arm 11 of the working device 4) toward the approaching side, the restriction of the rotation of the working device 4 (the arm 11 of the working device 4) toward the approaching side can be released.

Then, according to the backhoe 1, in the state in which the rotation of the working device 4 (the arm 11 of the working device 4) is restricted so as not to rotate the working device 4 (the arm 11 of the working device 4) toward the approaching side, the state in which the rotation of the working device 4 (the arm 11 of the working device 4) toward the approaching side is restricted can be released by easy operation of the working device 4.

Figure 18:
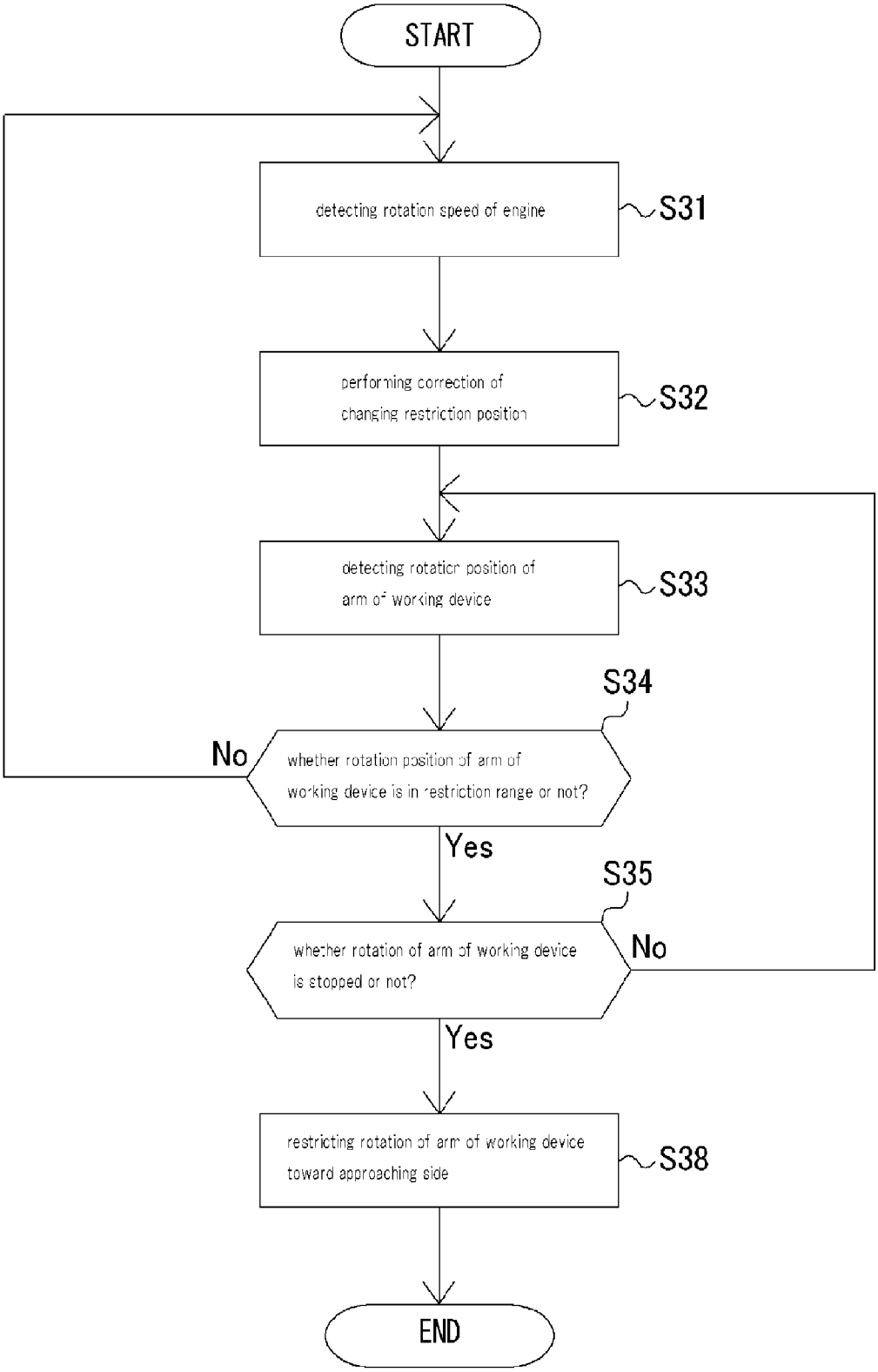
FIG. 18 is a flow chart of operation of the industrial vehicle.

Next, referring to FIG. 18, a series of operation in the backhoe 1 of another embodiment is explained that the rotation of the working device 4 (the arm 11 of the working device 4) is restricted so as not to rotate the working device 4 (the arm 11 of the working device 4) toward the approaching side in the restriction range D.

As shown in FIG. 18, the control device 30 of the backhoe 1 detects the rotation speed of the engine 9 (step S31).

At this time, the control device 30 obtains information about the rotation speed of the engine 9 from the engine 9 so as to detect the rotation speed of the engine 9.

After detecting the rotation speed of the engine 9 (step S31), the control device 30 shifts to a step S32.

Next, the control device 30 of the backhoe 1 performs the correction of narrowing the restriction range D set actually to the approaching side or the correction of expanding the restriction range D to the separating side based on the rotation speed of the engine 9 (step S32).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S32), the control device 30 shifts to a step S33.

Next, the control device 30 of the backhoe 1 detects the rotation position of the working device 4 (the arm 11 of the working device 4) (step S33).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S33), the control device 30 shifts to a step S34.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S33 (step S34).

When the rotation position of the working device 4 (the arm 11 of the working device 4) is judged not to be in the restriction range D, the control device 30 shifts to the step S31.

When the rotation position of the working device 4 (the arm 11 of the working device 4) is judged to be in the restriction range D (see FIG. 16), the control device 30 shifts to a step S35.

Next, the control device 30 of the backhoe 1 judges whether the rotation of the working device 4 (the arm 11 of the working device 4) is stopped in the restriction range D or not (step S35).

At this time, the control device 30 obtains information about the angle speed at the time of rotation of the arm 11 from the sensor 11*b* of the working device 4 so as to detect the angle speed at the time of rotation of the arm 11 of the working device 4.

Then, the control device 30 judges whether the rotation of the working device 4 (the arm 11 of the working device 4) is stopped in the restriction range D or not based on the detected angle speed at the time of rotation of the arm 11 of the working device 4.

When the rotation of the working device 4 (the arm 11 of the working device 4) is judged not to be stopped in the restriction range D, the control device 30 shifts to the step S33.

When the rotation of the working device 4 (the arm 11 of the working device 4) is judged to be stopped in the restriction range D (see FIG. 12), the control device 30 shifts to a step S38.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S38).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

As the above, in the backhoe 1 in which the control device 30 is configured so that the restriction range D is set at the separating side from the restriction position A and the rotation of the working device 4 (the arm 11 of the working device 4) is restricted so as not to rotate the working device 4 (the arm 11 of the working device 4) toward the approaching side in the restriction range D when the rotation of the working device 4 (the arm 11 of the working device 4) is stopped, the rotation of the working device 4 (the arm 11 of the working device 4) is restricted so as not to rotate the working device 4 (the arm 11 of the working device 4) toward the approaching side in the state in which the rotation of the working device 4 (the arm 11 of the working device 4) is stopped in the restriction range D.

Then, according to the backhoe 1, in the state in which the rotation of the working device 4 (the arm 11 of the working device 4) in the restriction range D, when the working device 4 (the arm 11 of the working device 4) is rotated suddenly toward the approaching side, the working device 4 (the arm 11 of the working device 4) can be prevented from being rotated toward the approaching side from the restriction position A.

Next, a series of operation in the backhoe 1 of another embodiment is explained that the rotation of the working device 4 (the arm 11 of the working device 4) is restricted so as not to rotate the working device 4 (the arm 11 of the working device 4) toward the approaching side in the restriction range D.

Figure 19:
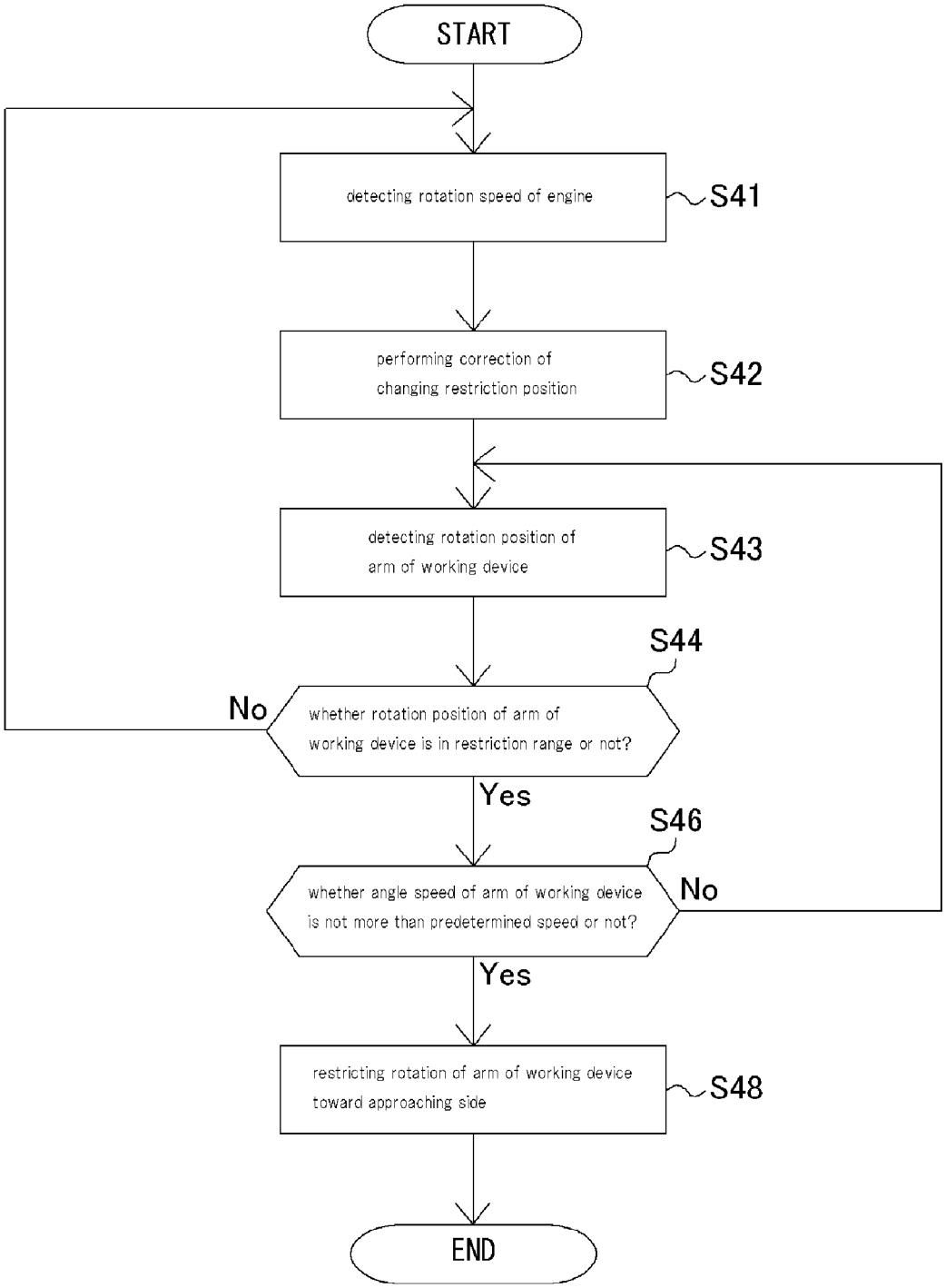
FIG. 19 is a flow chart of operation of the industrial vehicle.

As shown in FIG. 19, the control device 30 of the backhoe 1 detects the rotation speed of the engine 9 (step S41).

At this time, the control device 30 obtains information about the rotation speed of the engine 9 from the engine 9 so as to detect the rotation speed of the engine 9.

After detecting the rotation speed of the engine 9 (step S41), the control device 30 shifts to a step S42.

Next, the control device 30 of the backhoe 1 performs the correction of narrowing the restriction range D set actually to the approaching side or the correction of expanding the restriction range D to the separating side based on the rotation speed of the engine 9 (step S42).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S42), the control device 30 shifts to a step S43.

Next, the control device 30 of the backhoe 1 detects the rotation position of the working device 4 (the arm 11 of the working device 4) (step S43).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S43), the control device 30 shifts to a step S44.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S43 (step S44).

When the rotation position of the working device 4 (the arm 11 of the working device 4) is judged not to be in the restriction range D, the control device 30 shifts to the step S41.

When the rotation position of the working device 4 (the arm 11 of the working device 4) is judged to be in the restriction range D (see FIG. 16), the control device 30 shifts to a step S46.

Next, the control device 30 of the backhoe 1 judges whether the angle speed at the time of rotation of the working device 4 (the arm 11 of the working device 4) is not more than the predetermined speed in the restriction range D or not (step S46).

At this time, the control device 30 obtains information about the angle speed at the time of rotation of the arm 11 from the sensor 11*b* of the working device 4 so as to detect the angle speed at the time of rotation of the arm 11 of the working device 4.

Then, the control device 30 judges whether the angle speed at the time of rotation of the working device 4 (the arm 11 of the working device 4) in the restriction range D is not more than the predetermined amount or not based on the detected angle speed at the time of rotation of the arm 11 of the working device 4.

When the drop amount of rotation speed of the engine 9 per unit time is judged to be more than the predetermined amount in the restriction range D, the control device 30 shifts to the step S43.

When the drop amount of rotation speed of the engine 9 per unit time is judged not to be more than the predetermined amount in the restriction range D, the control device 30 shifts to the step S48.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S48).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

As the above, in the backhoe 1 in which the control device 30 is configured so that the rotation of the working device 4 (the arm 11 of the working device 4) is restricted so as not to rotate the working device 4 (the arm 11 of the working device 4) toward the approaching side when the angle speed at the time of rotation of the working device 4 (the arm 11 of the working device 4) is not more than the predetermined speed in the restriction range D, the rotation of the working device 4 (the arm 11 of the working device 4) is restricted so as not to rotate the working device 4 (the arm 11 of the working device 4) toward the approaching side in the state in which the angle speed at the time of rotation of the working device 4 (the arm 11 of the working device 4) is not more than the predetermined speed in the restriction range D.

Then, according to the backhoe 1, in the state in which the angle speed at the time of rotation of the working device 4 (the arm 11 of the working device 4) is not more than the predetermined speed, when the working device 4 (the arm 11 of the working device 4) is rotated suddenly toward the approaching side while increasing the speed, the working device 4 (the arm 11 of the working device 4) can be prevented from being rotated toward the approaching side from the restriction position A.

Next, a series of operation in the backhoe 1 of another embodiment is explained that the rotation of the working device 4 (the arm 11 of the working device 4) is restricted so as not to rotate the working device 4 (the arm 11 of the working device 4) toward the approaching side in the restriction range D.

Figure 20:
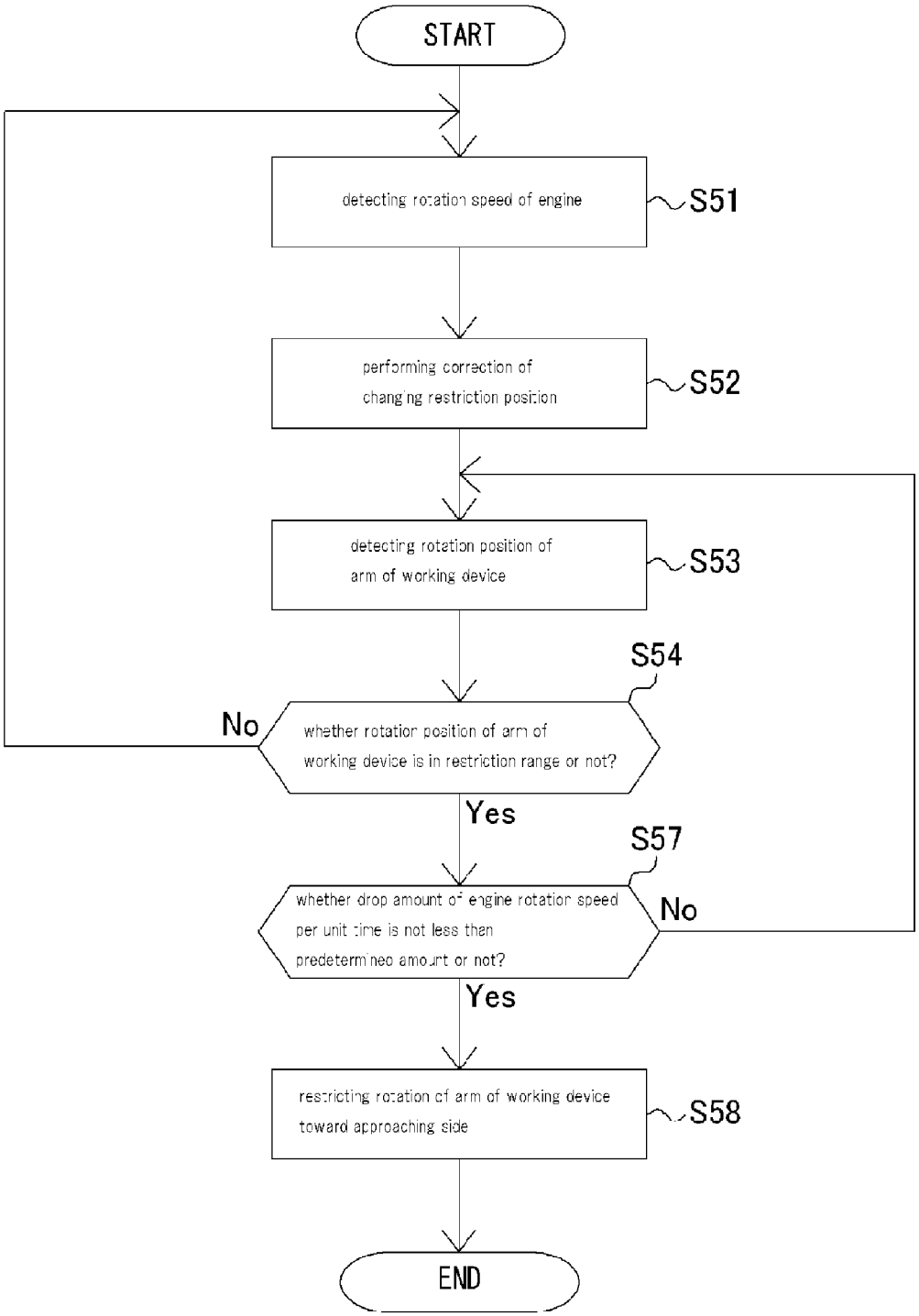
FIG. 20 is a flow chart of operation of the industrial vehicle.

As shown in FIG. 20, the control device 30 of the backhoe 1 detects the rotation speed of the engine 9 (step S51).

At this time, the control device 30 obtains information about the rotation speed of the engine 9 from the engine 9 so as to detect the rotation speed of the engine 9.

After detecting the rotation speed of the engine 9 (step S51), the control device 30 shifts to a step S52.

Next, the control device 30 of the backhoe 1 performs the correction of narrowing the restriction range D set actually to the approaching side or the correction of expanding the restriction range D to the separating side based on the rotation speed of the engine 9 (step S52).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S52), the control device 30 shifts to a step S53.

Next, the control device 30 of the backhoe 1 detects the rotation position of the working device 4 (the arm 11 of the working device 4) (step S53).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S53), the control device 30 shifts to a step SM.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S53 (step S54).

When the rotation position of the working device 4 (the arm 11 of the working device 4) is judged not to be in the restriction range D, the control device 30 shifts to the step SM.

When the rotation position of the working device 4 (the arm 11 of the working device 4) is judged to be in the restriction range D (see FIG. 16), the control device 30 shifts to a step S57.

Next, the control device 30 of the backhoe 1 judges whether the drop amount of rotation speed of the engine 9 per unit time is not less than the predetermined amount in the restriction range D or not (step S57).

At this time, the control device 30 obtains information about the rotation speed of the engine 9 from the engine 9 so as to detect the rotation speed of the engine 9.

Then, the control device 30 judges whether the drop amount of rotation speed of the engine 9 per unit time is not less than the predetermined amount in the restriction range D or not based on the detected rotation speed of the engine 9 (see FIG. 13).

When the drop amount of rotation speed of the engine 9 per unit time is judged to be less than the predetermined amount in the restriction range D, the control device 30 shifts to the step S53.

When the drop amount of rotation speed of the engine 9 per unit time is judged not to be less than the predetermined amount in the restriction range D, the control device 30 shifts to a step S58.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S58).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

As the above, in the backhoe 1 in which the control device 30 is configured so that the rotation of the working device 4 (the arm 11 of the working device 4) is restricted so as not to rotate the working device 4 (the arm 11 of the working device 4) toward the approaching side when the drop amount of rotation speed of the engine 9 per unit time is not less than the predetermined amount in the restriction range D, the rotation of the working device 4 (the arm 11 of the working device 4) is restricted so as not to rotate the working device 4 (the arm 11 of the working device 4) toward the approaching side when the drop amount of rotation speed of the engine 9 per unit time is not less than the predetermined amount in the restriction range D.

As the above, in the backhoe 1, the timing of restricting the rotation of the working device 4 (the arm 11 of the working device 4) so as not to rotate the working device 4 (the arm 11 of the working device 4) toward the approaching side is judged from the drop amount of rotation speed of the engine 9. Accordingly, in comparison with the configuration of performing the judgement from the angle speed at the time of rotation of the working device 4 (the arm 11 of the working device 4), the judgement of restricting the rotation of the working device 4 (the arm 11 of the working device 4) so as not to rotate the working device 4 (the arm 11 of the working device 4) toward the approaching side can be performed more quickly.

Then, according to the backhoe 1, in comparison with the configuration of performing the judgement the timing of restricting the rotation of the working device 4 (the arm 11 of the working device 4) from the angle speed at the time of rotation of the working device 4 (the arm 11 of the working device 4), when the working device 4 (the arm 11 of the working device 4) is rotated suddenly toward the approaching side while increasing the speed, the working device 4 (the arm 11 of the working device 4) can be prevented more certainly from being rotated toward the approaching side from the restriction position A.

Next, a series of operation in the backhoe 1 of another embodiment is explained that the rotation of the working device 4 (the arm 11 of the working device 4) is restricted so as not to rotate the working device 4 (the arm 11 of the working device 4) toward the approaching side in the restriction range D.

Figure 21:
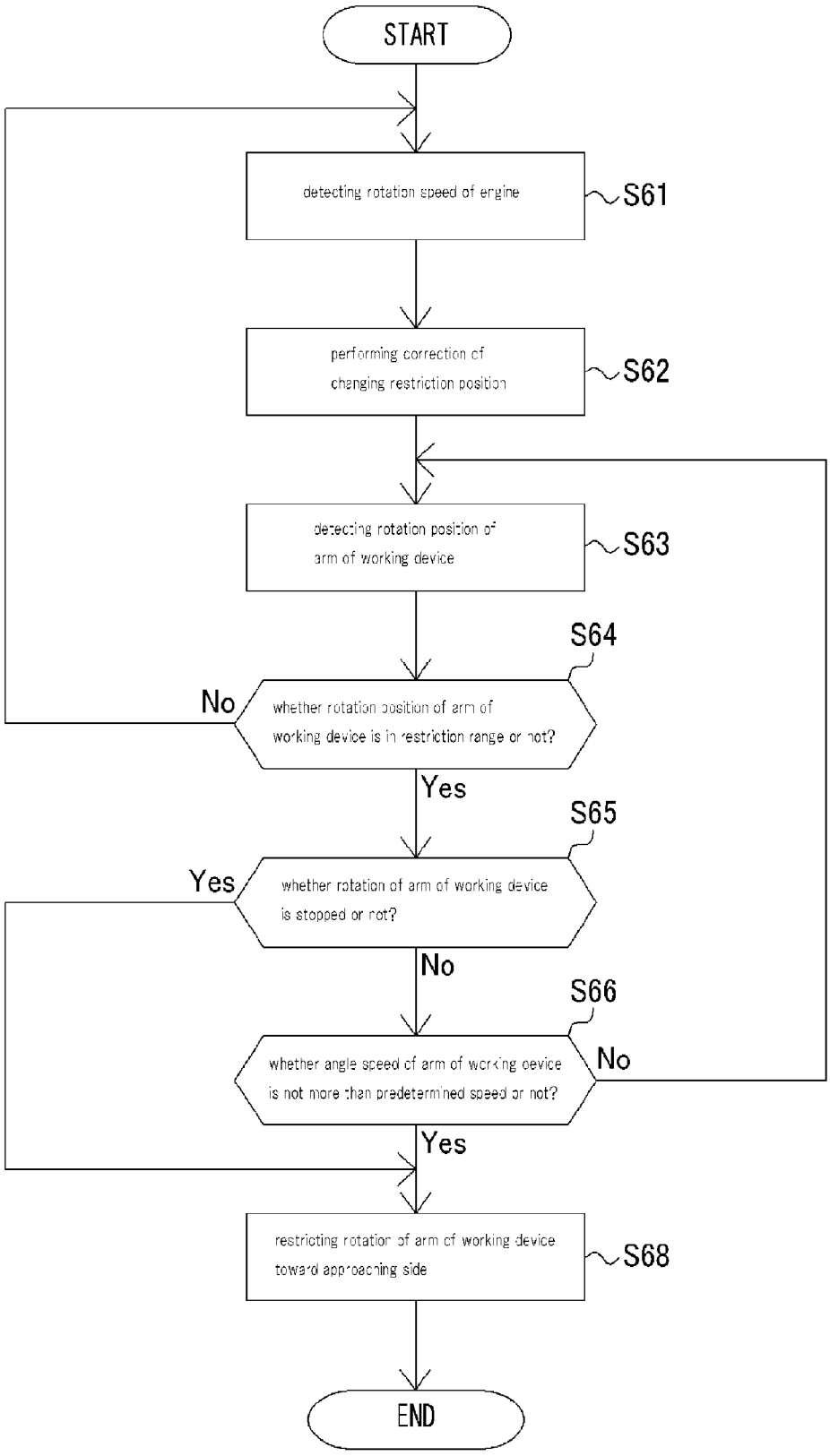
FIG. 21 is a flow chart of operation of the industrial vehicle.

As shown in FIG. 21, the control device 30 of the backhoe 1 detects the rotation speed of the engine 9 (step S61).

At this time, the control device 30 obtains information about the rotation speed of the engine 9 from the engine 9 so as to detect the rotation speed of the engine 9.

After detecting the rotation speed of the engine 9 (step S61), the control device 30 shifts to a step S62.

Next, the control device 30 of the backhoe 1 performs the correction of narrowing the restriction range D set actually to the approaching side or the correction of expanding the restriction range D to the separating side based on the rotation speed of the engine 9 (step S62).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S62), the control device 30 shifts to a step S63.

Next, the control device 30 of the backhoe 1 detects the rotation position of the working device 4 (the arm 11 of the working device 4) (step S63).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S63), the control device 30 shifts to a step S64.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S63 (step S64).

When the rotation position of the working device 4 (the arm 11 of the working device 4) is judged not to be in the restriction range D, the control device 30 shifts to the step S61.

When the rotation position of the working device 4 (the arm 11 of the working device 4) is judged to be in the restriction range D (see FIG. 16), the control device 30 shifts to a step S65.

Next, the control device 30 of the backhoe 1 judges whether the rotation of the working device 4 (the arm 11 of the working device 4) is stopped in the restriction range D or not (step S65).

At this time, the control device 30 obtains information about the angle speed at the time of rotation of the arm 11 from the sensor 11*b* of the working device 4 so as to detect the angle speed at the time of rotation of the arm 11 of the working device 4.

Then, the control device 30 judges whether the rotation of the working device 4 (the arm 11 of the working device 4) is stopped in the restriction range D or not based on the detected angle speed at the time of rotation of the arm 11 of the working device 4.

When the rotation of the working device 4 (the arm 11 of the working device 4) is judged not to be stopped in the restriction range D, the control device 30 shifts to a step S66.

When the rotation of the working device 4 (the arm 11 of the working device 4) is judged to be stopped in the restriction range D (see FIG. 12), the control device 30 shifts to a step S68.

Next, the control device 30 of the backhoe 1 judges whether the angle speed at the time of rotation of the working device 4 (the arm 11 of the working device 4) is not more than the predetermined speed in the restriction range D or not (step S66).

At this time, the control device 30 judges whether the angle speed at the time of rotation of the working device 4 (the arm 11 of the working device 4) is not more than the predetermined speed in the restriction range D or not based on the angle speed at the time of rotation of the arm 11 of the working device 4 detected in the step S65.

When the angle speed at the time of rotation of the working device 4 (the arm 11 of the working device 4) is judged to be more than the predetermined speed in the restriction range D, the control device 30 shifts to a step S63.

When the angle speed at the time of rotation of the working device 4 (the arm 11 of the working device 4) is judged not to be more than the predetermined speed in the restriction range D, the control device 30 shifts to the step S68.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S68).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

As the above, in the backhoe 1 in which the control device 30 is configured so that the restriction range D is set at the separating side from the restriction position A and the rotation of the working device 4 (the arm 11 of the working device 4) is restricted so as not to rotate the working device 4 (the arm 11 of the working device 4) toward the approaching side in the restriction range D when the rotation of the working device 4 (the arm 11 of the working device 4) is stopped, the rotation of the working device 4 (the arm 11 of the working device 4) is restricted so as not to rotate the working device 4 (the arm 11 of the working device 4) toward the approaching side in the state in which the rotation of the working device 4 (the arm 11 of the working device 4) is stopped in the restriction range D.

Then, according to the backhoe 1, in the state in which the rotation of the working device 4 (the arm 11 of the working device 4) in the restriction range D, when the working device 4 (the arm 11 of the working device 4) is rotated suddenly toward the approaching side, the working device 4 (the arm 11 of the working device 4) can be prevented from being rotated toward the approaching side from the restriction position A.

As the above, in the backhoe 1 in which the control device 30 is configured so that the rotation of the working device 4 (the arm 11 of the working device 4) is restricted so as not to rotate the working device 4 (the arm 11 of the working device 4) toward the approaching side when the angle speed at the time of rotation of the working device 4 (the arm 11 of the working device 4) is not more than the predetermined speed in the restriction range D, the rotation of the working device 4 (the arm 11 of the working device 4) is restricted so as not to rotate the working device 4 (the arm 11 of the working device 4) toward the approaching side in the state in which the angle speed at the time of rotation of the working device 4 (the arm 11 of the working device 4) is not more than the predetermined speed in the restriction range D.

Then, according to the backhoe 1, in the state in which the angle speed at the time of rotation of the working device 4 (the arm 11 of the working device 4) is not more than the predetermined speed, when the working device 4 (the arm 11 of the working device 4) is rotated suddenly toward the approaching side while increasing the speed, the working device 4 (the arm 11 of the working device 4) can be prevented from being rotated toward the approaching side from the restriction position A.

Next, a series of operation in the backhoe 1 of another embodiment is explained that the rotation of the working device 4 (the arm 11 of the working device 4) is restricted so as not to rotate the working device 4 (the arm 11 of the working device 4) toward the approaching side in the restriction range D.

Figure 22:
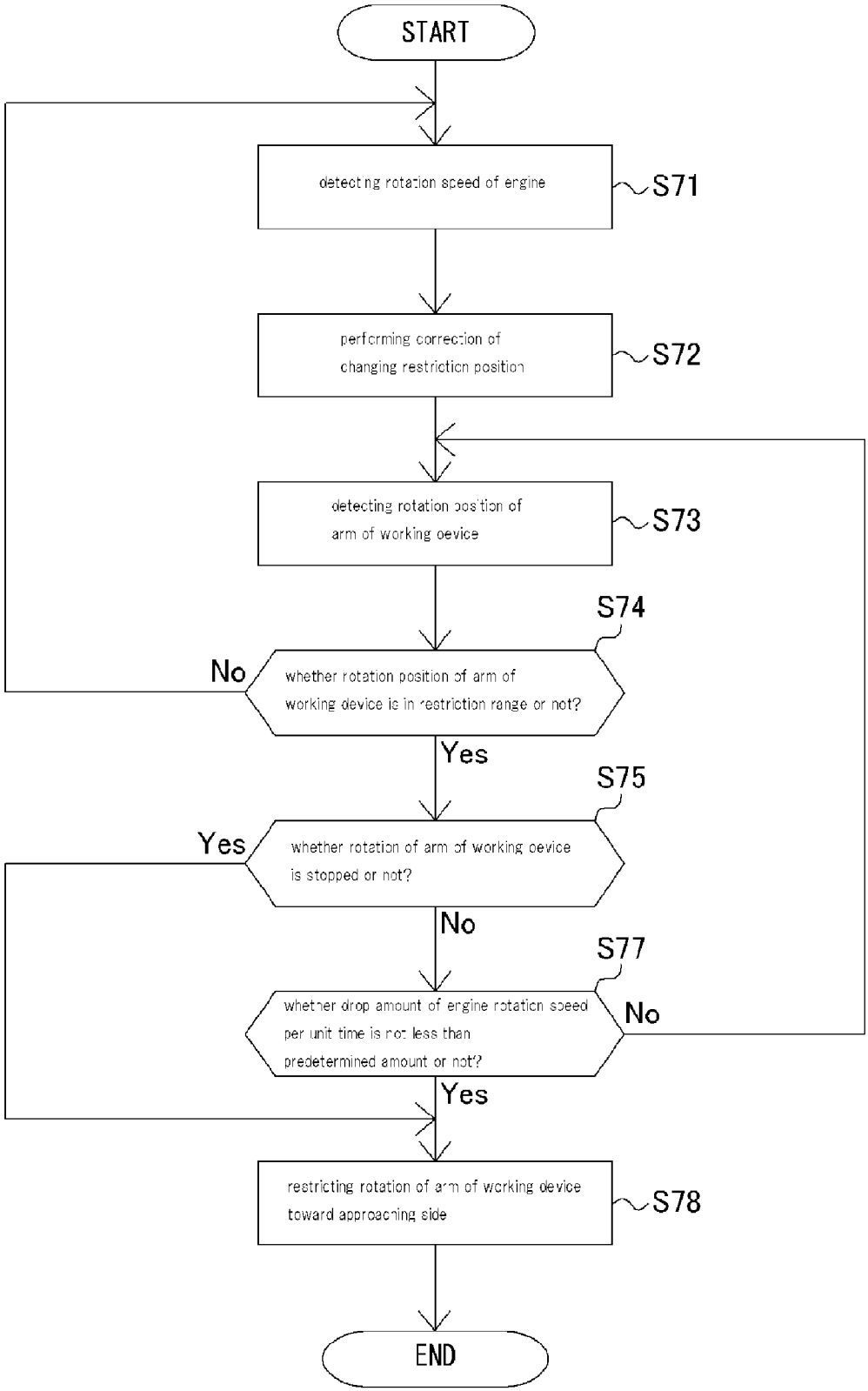
FIG. 22 is a flow chart of operation of the industrial vehicle.

As shown in FIG. 22, the control device 30 of the backhoe 1 detects the rotation speed of the engine 9 (step S71).

At this time, the control device 30 obtains information about the rotation speed of the engine 9 from the engine 9 so as to detect the rotation speed of the engine 9.

After detecting the rotation speed of the engine 9 (step S71), the control device 30 shifts to a step S72.

Next, the control device 30 of the backhoe 1 performs the correction of narrowing the restriction range D set actually to the approaching side or the correction of expanding the restriction range D to the separating side based on the rotation speed of the engine 9 (step S72).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S72), the control device 30 shifts to a step S73.

Next, the control device 30 of the backhoe 1 detects the rotation position of the working device 4 (the arm 11 of the working device 4) (step S73).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S73), the control device 30 shifts to a step S74.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S73 (step S74).

When the rotation position of the working device 4 (the arm 11 of the working device 4) is judged not to be in the restriction range D, the control device 30 shifts to the step S71.

When the rotation position of the working device 4 (the arm 11 of the working device 4) is judged to be in the restriction range D (see FIG. 16), the control device 30 shifts to a step S75.

Next, the control device 30 of the backhoe 1 judges whether the rotation of the working device 4 (the arm 11 of the working device 4) is stopped in the restriction range D or not (step S75).

At this time, the control device 30 obtains information about the angle speed at the time of rotation of the arm 11 from the sensor 11*b* of the working device 4 so as to detect the angle speed at the time of rotation of the arm 11 of the working device 4.

Then, the control device 30 judges whether the rotation of the working device 4 (the arm 11 of the working device 4) is stopped in the restriction range D or not based on the detected angle speed at the time of rotation of the arm 11 of the working device 4.

When the rotation of the working device 4 (the arm 11 of the working device 4) is judged not to be stopped in the restriction range D, the control device 30 shifts to a step S77.

When the rotation of the working device 4 (the arm 11 of the working device 4) is judged to be stopped in the restriction range D, the control device 30 shifts to a step S78.

Next, the control device 30 of the backhoe 1 judges whether the drop amount of rotation speed of the engine 9 per unit time is not less than the predetermined amount in the restriction range D or not (step S77).

At this time, the control device 30 obtains information about the rotation speed of the engine 9 from the engine 9 so as to detect the rotation speed of the engine 9.

Then, the control device 30 judges whether the drop amount of rotation speed of the engine 9 per unit time is not less than the predetermined amount in the restriction range D or not based on the detected rotation speed of the engine 9 (see FIG. 13).

When the drop amount of rotation speed of the engine 9 per unit time is judged to be less than the predetermined amount in the restriction range D, the control device 30 shifts to the step S73.

When the drop amount of rotation speed of the engine 9 per unit time is judged not to be less than the predetermined amount in the restriction range D, the control device 30 shifts to the step S78.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S78).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

Next, a series of operation in the backhoe 1 of another embodiment is explained that the rotation of the working device 4 (the arm 11 of the working device 4) is restricted so as not to rotate the working device 4 (the arm 11 of the working device 4) toward the approaching side in the restriction range D.

Figure 23:
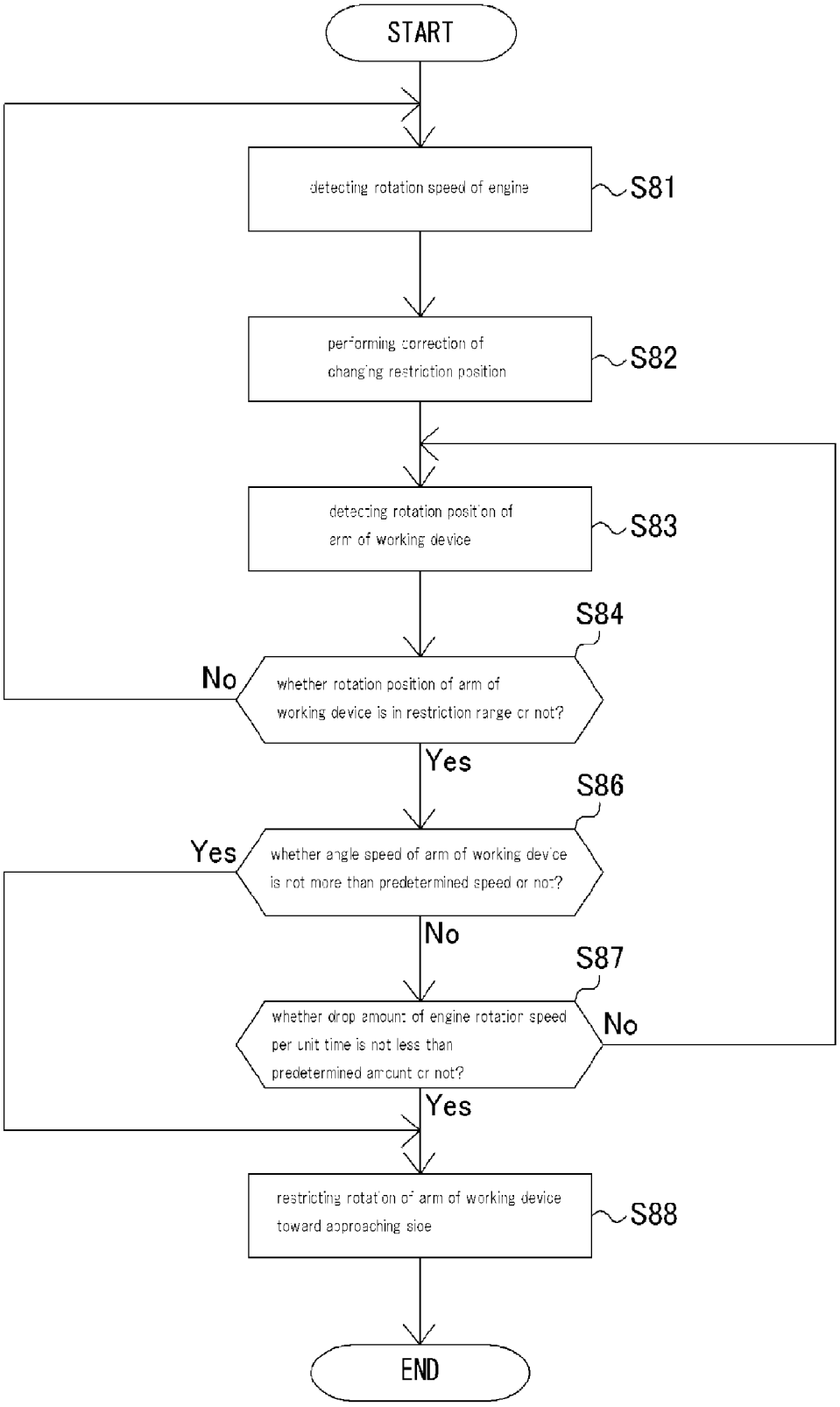
FIG. 23 is a flow chart of operation of the industrial vehicle.

As shown in FIG. 23, the control device 30 of the backhoe 1 detects the rotation speed of the engine 9 (step S81).

At this time, the control device 30 obtains information about the rotation speed of the engine 9 from the engine 9 so as to detect the rotation speed of the engine 9.

After detecting the rotation speed of the engine 9 (step S81), the control device 30 shifts to a step S82.

Next, the control device 30 of the backhoe 1 performs the correction of narrowing the restriction range D set actually to the approaching side or the correction of expanding the restriction range D to the separating side based on the rotation speed of the engine 9 (step S82).

At this time, the control device 30 refers to the rotation speed of the engine 9 and a map stored previously in the control device 30 so as to calculate a correction value for correcting the restriction range D.

Then, based on the calculated correction value for correcting the restriction range D, the control device 30 sets the new restriction range D which is narrowed to the approaching side or expanded to the separating side from the restriction range D set actually.

Accordingly, the control device 30 performs the correction of narrowing the restriction range D set actually to the approaching side or the correction of expanding the restriction range D to the separating side based on the rotation speed of the engine 9 (see FIG. 14 or 15).

After performing the correction of narrowing the restriction range D set actually to the approaching side or the correction of expanding the restriction range D to the separating side based on the rotation speed of the engine 9 (step S82), the control device 30 shifts to a step S83.

Next, the control device 30 of the backhoe 1 detects the rotation position of the working device 4 (the arm 11 of the working device 4) (step S83).

At this time, the control device 30 obtains information about the rotation position of the working device 4 (the arm 11 of the working device 4) from the sensor 11*b* of the working device 4 so as to detect the rotation position of the working device 4 (the arm 11 of the working device 4).

After detecting the rotation position of the working device 4 (the arm 11 of the working device 4) (step S83), the control device 30 shifts to a step S84.

Next, the control device 30 of the backhoe 1 judges whether the rotation position of the working device 4 (the arm 11 of the working device 4) is in the restriction range D or not based on the rotation position of the working device 4 (the arm 11 of the working device 4) detected in the step S83 (step S84).

When the rotation position of the working device 4 (the arm 11 of the working device 4) is judged not to be in the restriction range D, the control device 30 shifts to the step S81.

When the rotation position of the working device 4 (the arm 11 of the working device 4) is judged to be in the restriction range D (see FIG. 16), the control device 30 shifts to a step S86.

Next, the control device 30 of the backhoe 1 judges whether the angle speed at the time of rotation of the working device 4 (the arm 11 of the working device 4) is not more than the predetermined speed in the restriction range D or not (step S86).

At this time, the control device 30 obtains information about the angle speed at the time of rotation of the arm 11 from the sensor 11*b* of the working device 4 so as to detect the angle speed at the time of rotation of the arm 11 of the working device 4.

Then, the control device 30 judges whether the angle speed at the time of rotation of the working device 4 (the arm 11 of the working device 4) in the restriction range D is not more than the predetermined amount or not based on the detected angle speed at the time of rotation of the arm 11 of the working device 4.

When the drop amount of rotation speed of the engine 9 per unit time is judged to be more than the predetermined amount in the restriction range D, the control device 30 shifts to a step S87.

When the drop amount of rotation speed of the engine 9 per unit time is judged not to be more than the predetermined amount in the restriction range D, the control device 30 shifts to the step S88.

Next, the control device 30 of the backhoe 1 judges whether the drop amount of rotation speed of the engine 9 per unit time is not less than the predetermined amount in the restriction range D or not (step S87).

At this time, the control device 30 obtains information about the rotation speed of the engine 9 from the engine 9 so as to detect the rotation speed of the engine 9.

Then, the control device 30 judges whether the drop amount of rotation speed of the engine 9 per unit time is not less than the predetermined amount in the restriction range D or not based on the detected rotation speed of the engine 9 (see FIG. 13).

When the drop amount of rotation speed of the engine 9 per unit time is judged to be less than the predetermined amount in the restriction range D, the control device 30 shifts to the step S83.

When the drop amount of rotation speed of the engine 9 per unit time is judged not to be less than the predetermined amount in the restriction range D, the control device 30 shifts to the step S88.

Next, the control device 30 of the backhoe 1 restricts the rotation of the working device 4 (the arm 11 of the working device 4) so as not to rotate the working device 4 (the arm 11 of the working device 4) toward the approaching side in the restriction range D (step S88).

Accordingly, the series of operation in the backhoe 1 that the rotation of the working device 4 (the arm 11 of the working device 4) is restricted so as not to rotate the working device 4 (the arm 11 of the working device 4) toward the approaching side in the restriction range D of the backhoe 1 is performed.

The backhoe 1 may be configured so that information about the restriction position, information about the offset position, information about the restriction releasing position and information about the restriction range are stored in the control device 30.

Figure 24:
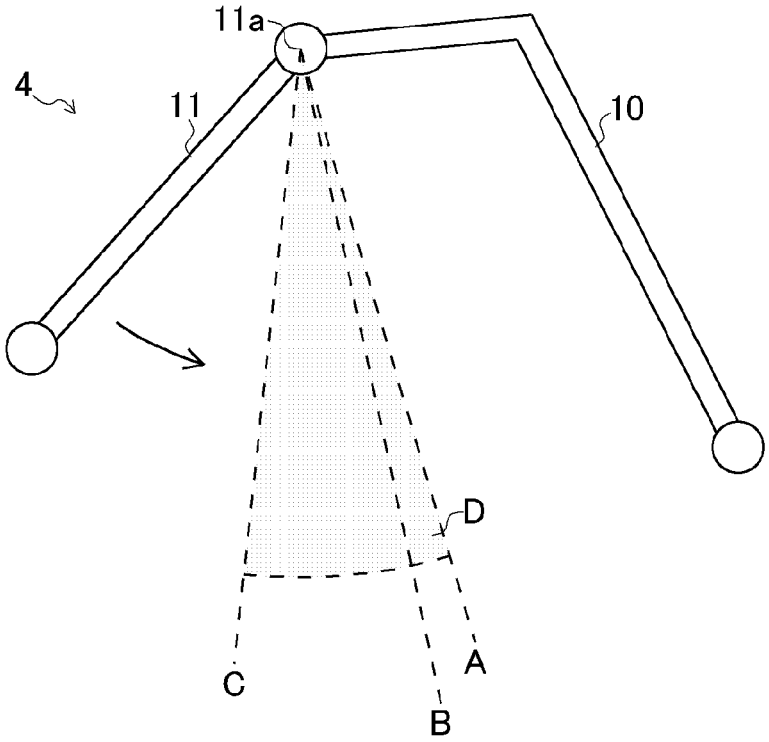
FIG. 24 is a schematic drawing of a rotation state of the working device of the industrial vehicle.

At this time, the control device 30 is configured so that the restriction range D is set at the separating side from the restriction position A and the offset position B (see FIG. 24).

INDUSTRIAL APPLICABILITY

The present invention can be used for an art of an industrial vehicle.

DESCRIPTION OF NOTATIONS

1 backhoe
2 traveling device
3 revolving device
4 working device
9 engine
10 boom
11 arm
12 bucket
11*a* arm fulcrum
11*b* sensor
20 hydraulic circuit
21 hydraulic pump

22 switching valve
23 pressure oil thermometer
30 control device
A restriction position
B offset position
C restriction releasing position
D restriction range

The invention claimed is:

1. An industrial vehicle comprising:

a working device equipped with an attachment and rotatable toward an approaching side and a separating side centering around a joint;

a control device restricting rotation of the working device toward the approaching side from a restriction position, an engine; and a hydraulic circuit which has a hydraulic pump driven with the engine as a power source, rotates the working device by supplying pressure oil from the hydraulic pump to the working device, and stops the rotation of the working device by stopping the supply of the pressure oil from the hydraulic pump to the working device, characterized in that the control device is configured so that an offset position is set at the separating side from the restriction position, when the working device rotating toward the approaching side reaches the offset position, an operation stopping the rotation of the working device toward the approaching side is started, and the control device performs correction that the offset position is shifted to the approaching side or the separating side based on an angle speed at the time of rotation of the working device, a temperature of the pressure oil and/or a rotation speed of the engine.

2. The industrial vehicle according to claim 1, wherein the control device is configured so that a restriction range is set at the separating side from the restriction position and the rotation of the working device is restricted so as not to rotate the working device toward the approaching side when the rotation of the working device is stopped in the restriction range.

3. The industrial vehicle according to claim 2, wherein the control device restricts the rotation of the working device so as not to rotate the working device toward the approaching side when the angle speed at the time of rotation of the working device is not more than a predetermined speed in the restriction range.

4. The industrial vehicle according to claim 2, wherein the control device restricts the rotation of the working device so as not to rotate the working device toward the approaching side when a drop amount of rotation speed of the engine per unit time is not less than a predetermined amount in the restriction range.

5. The industrial vehicle according to claim 2, wherein the control device performs correction of narrowing the restriction range to the approaching side or correction of expanding the restriction range to the separating side based on the rotation speed of the engine.

6. The industrial vehicle according to claim 2, wherein in the state in which the rotation of the working device is restricted so as not to rotate the working device toward the approaching side, when an engine key switch is turned OFF while communication abnormality is detected, the control device releases the state of restricting the rotation of the working device toward the approaching side.

* * * * *